US011559733B2

(12) United States Patent
Rouzier et al.

(10) Patent No.: US 11,559,733 B2
(45) **Date of Patent: *Jan. 24, 2023**

(54) ICE SKATE

(71) Applicant: Bauer Hockey, LLC, Exeter, NH (US)

(72) Inventors: Edouard Rouzier, Monreal (CA); Adam Gans, Prevost (CA); Martin Chambert, Piedmont (CA); Pascal Martel, Montreal (CA)

(73) Assignee: BAUER HOCKEY, LLC, Exeter, NH (US)

( * ) Notice: Subject to any disclaimer, the term of this patent is extended or adjusted under 35 U.S.C. 154(b) by 624 days.

This patent is subject to a terminal disclaimer.

(21) Appl. No.: 16/528,867

(22) Filed: Aug. 1, 2019

(65) Prior Publication Data

US 2019/0351313 A1 Nov. 21, 2019

Related U.S. Application Data

(63) Continuation of application No. 14/988,191, filed on Jan. 5, 2016, now Pat. No. 10,406,424.

(60) Provisional application No. 62/099,795, filed on Jan. 5, 2015.

(51) Int. Cl.
*A63C 1/30* (2006.01)
*A63C 1/32* (2006.01)

(52) U.S. Cl.
CPC ..... *A63C 1/30* (2013.01); *A63C 1/303* (2013.01); *A63C 1/32* (2013.01)

(58) Field of Classification Search
CPC .. A63C 1/30; A63C 1/303; A63C 1/32; A63C 1/42; A63C 2203/42
See application file for complete search history.

(56) References Cited

U.S. PATENT DOCUMENTS

| | | | | |
|---|---|---|---|---|
| 37,934 A | | 3/1863 | Yates | |
| 1,371,609 A | * | 3/1921 | Drevitson | A63C 1/42 D21/761 |
| 1,666,690 A | | 4/1928 | Drevitson | |
| 1,773,017 A | | 8/1930 | Thompson | |
| 4,008,901 A | | 2/1977 | Conn | |

(Continued)

FOREIGN PATENT DOCUMENTS

| | | |
|---|---|---|
| CA | 2638352 | 2/2009 |
| CA | 2916673 | 7/2016 |

(Continued)

OTHER PUBLICATIONS

Advisory Action dated Mar. 22, 2018 in connection with U.S. Appl. No. 14/488,191, 3 pages.

(Continued)

*Primary Examiner* — Katy M Ebner

(57) ABSTRACT

A blade holder for an ice skate (e.g., for playing hockey). The ice skate comprises a skate boot for receiving a foot of a skater. The blade holder comprises a blade-retaining base to retain a blade. The blade-retaining base comprises a first material (e.g., a non-composite polymeric material). The blade holder comprises a support extending upwardly from the blade-retaining base to interconnect the blade holder and the skate boot. The support comprises a second material (e.g., a composite material) different from (e.g., stiffer than) the first material.

32 Claims, 28 Drawing Sheets

(56) References Cited

U.S. PATENT DOCUMENTS 4,053,168 A * 10/1977 Goverde ..... A63C 1/42 280/11.12
4,218,069 A * 8/1980 Baikie ..... A63C 1/42 280/11.18
4,453,727 A 6/1984 Bourque
4,509,276 A 4/1985 Bourque
4,549,742 A 10/1985 Idusak et al.
5,248,156 A 9/1993 Cann et al.
5,326,115 A 5/1994 Seltzer
5,332,242 A * 7/1994 Cann ..... A63C 1/303 280/11.18
5,484,148 A * 1/1996 Olivieri ..... A63C 1/30 280/11.18
5,505,467 A 4/1996 Hill
5,641,169 A * 6/1997 Bekessy ..... A63C 1/30 280/11.18
5,769,434 A * 6/1998 Wurthner ..... A63C 1/30 280/11.18
5,839,734 A 11/1998 Steinhauser
5,988,683 A * 11/1999 Venier ..... A63C 1/30 280/841
6,105,975 A * 8/2000 Shum ..... A63C 1/32 280/11.12
6,109,622 A * 8/2000 Reynolds ..... A63C 1/303 280/11.18
6,164,667 A * 12/2000 Olivieri ..... A63C 1/32 280/11.18
6,416,064 B1 7/2002 Evans
6,467,778 B1 * 10/2002 Goldsmith ..... A63C 1/22 280/11.18
6,485,033 B2 * 11/2002 Nicoletti ..... A63C 1/303 280/11.18
6,761,363 B2 7/2004 Fask et al.
7,380,801 B2 6/2008 Rudolph
7,392,991 B2 7/2008 Labonte
7,628,405 B2 12/2009 Smith, II
7,673,884 B2 * 3/2010 Wuerthner ..... A63C 1/32 280/610
7,758,053 B2 7/2010 Wylie et al.
7,793,947 B2 9/2010 Labonte
7,866,675 B2 1/2011 Hauser
7,896,363 B2 3/2011 Lovejoy
7,950,676 B2 5/2011 Goldsmith
8,109,536 B2 * 2/2012 Labonte ..... B29D 35/126 280/841
D659,216 S 5/2012 Wuerthner
8,277,284 B2 * 10/2012 Wilson ..... A63C 1/32 451/72
8,329,083 B2 11/2012 Jou et al.
8,353,535 B2 1/2013 Salmon et al.
8,387,286 B2 3/2013 Koyess et al.
8,505,217 B2 8/2013 Stewart
8,684,368 B2 4/2014 Van Horne et al.
8,770,595 B2 * 7/2014 Cruikshank ..... A63C 1/30 280/11.17
8,857,823 B2 10/2014 Mars
8,876,124 B2 11/2014 Pokupec
9,004,502 B2 4/2015 Van Horne et al.
9,084,927 B2 7/2015 Lewis
9,186,569 B2 11/2015 Wuerthner
9,295,901 B2 3/2016 Cruikshank et al.
D762,275 S 7/2016 Labonte
9,510,639 B2 12/2016 Cruikshank et al.
D784,471 S 4/2017 Labonte
9,693,600 B1 7/2017 Van Horne
9,936,762 B2 4/2018 Koyess et al.
D837,318 S 1/2019 Rouzier
10,195,514 B2 2/2019 Davis et al.
D844,726 S 4/2019 Rouzier
D845,410 S 4/2019 Rouzier
D845,416 S 4/2019 Rouzier
10,376,771 B2 8/2019 Rouzier et al.
10,406,424 B2 * 9/2019 Gans ..... A63C 1/30
D868,915 S 12/2019 Faucher et al.
10,532,269 B2 1/2020 Davis et al.
D875,196 S 2/2020 Evon
D888,176 S 6/2020 Evon
11,130,044 B2 9/2021 Davis et al.
2002/0175481 A1 * 11/2002 Steinhauser, Jr. ..... A63C 1/32 280/11.18
2003/0011150 A1 * 1/2003 Goldsmith ..... A63C 1/30 280/11.18
2004/0140631 A1 7/2004 Goldsmith
2004/0168357 A1 9/2004 Meibock
2005/0134010 A1 6/2005 Blakenburg
2006/0082081 A1 * 4/2006 Loveridge ..... A63C 1/02 280/11.12
2006/0108751 A1 * 5/2006 Labonte ..... A63C 1/22 280/11.18
2007/0037637 A1 2/2007 Jennings
2008/0001369 A1 1/2008 Wylie et al.
2008/0100008 A1 5/2008 Wan
2008/0252061 A1 10/2008 Demmers et al.
2009/0045616 A1 2/2009 Eldridge
2009/0224494 A1 9/2009 Wan
2009/0289427 A1 * 11/2009 Lovejoy ..... A63C 1/30 280/11.12
2010/0139126 A1 6/2010 Koyess
2010/0156058 A1 6/2010 Koyess et al.
2010/0176564 A1 7/2010 Koyess et al.
2010/0192412 A1 8/2010 Stewart
2010/0194062 A1 * 8/2010 Hauser ..... A63C 1/32 280/11.18
2010/0314844 A1 * 12/2010 Spah ..... A63C 1/36 280/11.18
2011/0001297 A1 1/2011 Labonte et al.
2011/0101665 A1 5/2011 Van Horne et al.
2011/0148054 A1 * 6/2011 Davis ..... A63C 1/32 280/11.3
2011/0198834 A1 * 8/2011 Olivieri ..... A63C 1/30 280/811
2012/0187642 A1 * 7/2012 Corbeil ..... A63C 1/303 280/11.18
2012/0317842 A1 12/2012 McClelland
2013/0038031 A1 * 2/2013 Cruikshank ..... A63C 1/42 280/11.18
2013/0285338 A1 * 10/2013 Blois ..... A63C 1/30 29/446
2014/0250733 A1 9/2014 Cruikshank et al.
2014/0265175 A1 * 9/2014 Labonte ..... A63C 1/32 280/11.18
2016/0001162 A1 * 1/2016 Azzolin ..... A63C 1/28 280/11.18
2016/0114239 A1 * 4/2016 Davis ..... A63C 1/303 280/11.12
2016/0193523 A1 7/2016 Gans et al.
2016/0236065 A1 8/2016 Cruikshank et al.
2017/0361200 A1 * 12/2017 Chartrand ..... A63C 1/42
2018/0117448 A1 5/2018 Rouzier et al.
2018/0361224 A1 12/2018 Labonte et al.
2019/0045879 A1 2/2019 Labonte et al.
2019/0160355 A1 5/2019 Rouzier
2019/0160363 A1 5/2019 Davis et al.
2019/0184250 A1 6/2019 Rouzier
2019/0255405 A1 8/2019 Rouzier
2019/0269997 A1 9/2019 Labonte et al.
2020/0222785 A1 7/2020 Davis
2021/0394038 A1 12/2021 Davis et al.

FOREIGN PATENT DOCUMENTS

CA 2935348 12/2017
CA 171235 6/2019
CA 3027838 6/2019
CA 2909496 7/2020
DE 545394 3/1932
EP 1013314 6/2000
EP 2478937 7/2012

(56) References Cited

FOREIGN PATENT DOCUMENTS

| | | |
|---|---|---|
| EP | 3415205 | 12/2018 |
| WO | 2013022787 | 2/2013 |

OTHER PUBLICATIONS

Examiner's Report dated Apr. 17, 2017 in connection with Canadian Design Application No. 171,235, 6 pages.
Examiner's Report dated Feb. 22, 2019 in connection with Canadian Design Application No. 171,235, 1 page.
Examiner's Report dated Feb. 22, 2019 in connection with Canadian Design Application No. 175,917, 2 pages.
Examiner's Report dated Feb. 22, 2019 in connection with Canadian Design Application No. 184,226, 1 page.
Examiner's Report dated Feb. 22, 2019 in connection with Canadian Design Application No. 184,225, 1 page.
Examiner's Report dated Jan. 17, 2018 in connection with Canadian Design Application No. 171,235, 3 pages.
Examiner's Report dated May 21, 2019 in connection with Canadian Patent Application No. 2,847,139, 4 pages.
Examiner's Report dated Aug. 25, 2020 in connection with Canadian Patent Application No. 2,847,139, 4 pages.
Examiner's Report dated Jan. 11, 2019 in connection with Canadian Patent Application No. 2,847,139, 4 pages.
Extended European Search report dated Nov. 21, 2018, in connection with European Patent Application No. 3415205, 10 pages.
Final Office Action dated Mar. 22, 2017 in connection with U.S. Appl. No. 14/920,664, 8 pages.
Final Office Action dated Jan. 22, 2019 in connection with U.S. Appl. No. 14/988,191, 8 pages.
Final Office Action dated Oct. 12, 2017 in connection with U.S. Appl. No. 14/212,468, 18 pages.
Final Office Action dated Dec. 21, 2017 in connection with U.S. Appl. No. 14/488,191, 11 pages.
Final Office Action dated Mar. 1, 2016 in connection with U.S. Appl. No. 14/212,468, 20 pages.
Non-Final Office action dated Dec. 9, 2021 in connection with U.S. Appl. No. 15/919,117, 26 pages.
Non-Final Office Action dated Dec. 26, 2018 in connection with U.S. Appl. No. 15/670,500, 9 pages.
Non-Final Office Action dated Jun. 20, 2018 in connection with U.S. Appl. No. 14/988,191, 10 pages.
Non-Final Office Action dated Feb. 4, 2021 in connection with U.S. Appl. No. 15/919,117, 37 pages.
Non-Final Office Action dated Feb. 6, 2017 in connection with U.S. Appl. No. 15/199,179, 8 pages.
Non-Final Office Action dated Jan. 25, 2018 in connection with U.S. Appl. No. 15/670,500, 6 pages.
Non-Final Office Action dated Jan. 28, 2021 in connection with U.S. Appl. No. 16/712,094, 8 pages.
Non-Final Office Action dated Mar. 20, 2017 in connection with U.S. Appl. No. 14/212,468, 25 pages.
Non-Final Office Action dated Mar. 30, 2020 in connection with U.S. Appl. No. 15/919,117, 40 pages.
Non-Final Office Action dated Mar. 7, 2018, in connection with U.S. Appl. No. 14/920,664, 7 pages.
Non-Final Office Action dated May 22, 2019 in connection with U.S. Appl. No. 16/225,095, 20 pages.
Non-Final Office Action dated May 29, 2018 in connection with U.S. Appl. No. 15/670,500, 9 pages.
Non-Final Office Action dated Oct. 20, 2020 in connection with Design U.S. Appl. No. 29/582,205, 14 pages.
Non-Final Office Action dated Sep. 10, 2015 in connection with U.S. Appl. No. 14/212,468, 15 pages.
Non-Final Office Action dated Sep. 14, 2016 in connection with U.S. Appl. No. 14/920,664, 7 pages.
Non-Final Office Action dated Sep. 26, 2017 in connection with U.S. Appl. No. 14/920,664, 8 pages.
Non-Final Office Action dated May 17, 2017 in connection with U.S. Appl. No. 14/988,191, 25 pages.
Non-Final Office Action dated Jun. 11, 2021 in connection with Design U.S. Appl. No. 29/582,205, 6 pages.
Notice of Allowance dated Apr. 3, 2019 in connection with U.S. Appl. No. 15/670,500, 20 pages.
Notice of Allowance dated Apr. 30, 2019 in connection with U.S. Appl. No. 14/988,191, 6 pages.
Notice of Allowance dated Sep. 19, 2018 in connection with U.S. Appl. No. 14/920,664, 7 pages.
Notice of Allowance dated Sep. 9, 2019 in connection with U.S. Appl. No. 16/225,095, 7 pages.
Office Action dated Apr. 16, 2020 in connection with Design U.S. Appl. No. 29/582,205, 7 pages.
Communication pursuant to Article 94(3) dated May 8, 2015 in connection with European Patent Application No. 14160032.0, 3 pages.
Restriction Requirement dated May 15, 2015 in connection with U.S. Appl. No. 14/212,468, 8 pages.
Restriction Requirement dated Mar. 14, 2016 in connection with U.S. Appl. No. 14/920,664, 8 pages.
Restriction Requirement dated Oct. 3, 2019 in connection with Design U.S. Appl. No. 29/582,205, 7 pages.
Examiner's Report dated Mar. 24, 2021 in connection with Canadian patent application No. 2847139, 4 pages.
Notice of Allowance dated May 26, 2021 in connection with U.S. Appl. No. 16/712,094, 25 pages.
Examiner's Report dated May 4, 2021 in connection with Canadian Patent Application No. 3,053,924, 4 pages.
Non-Final Office Action dated Jul. 23, 2021 in connection with U.S. Appl. No. 16/295,497, 6 pages.
Examiner's Report dated Nov. 24, 2021 in connection with Canadian Patent Application No. 3,053,924, 3 pages.
Notice of Allowance dated Nov. 25, 2021 in connection with Canadian patent application No. 2847139, 1 page.
Easton Hockey catalog 1998—composite blade holder, 7 pages.
Easton Hockey catalog 2000, Extracts of pp. 5, 6 and 7.
Mission holder called the driveshaft with a carbon insert—print out of web page from hockey world website—Jul. 13, 2015, 2 pages.
Examiner's Report dated Feb. 23, 2022 in connection with Canadian Patent Application No. 2916673, 15 pages.
Restriction requirement dated Feb. 26, 2021 in connection with U.S. Appl. No. 16/295,497, 8 pages.
Non-Final Office Action dated Mar. 4, 2022 in connection with U.S. Appl. No. 16/295,497, 21 pages.
Non-Final Office Action dated Jun. 15, 2022 in connection with U.S. Appl. No. 15/919,117, 6 pages.

* cited by examiner

ICE SKATE

CROSS-REFERENCE TO RELATED APPLICATION

This application is a continuation of U.S. patent application Ser. No. 14/988,191, filed on Jan. 5, 2019, and claims priority from U.S. Patent Application Ser. No. 62/099,795 having a priority date of Jan. 5, 2015. The contents of the aforementioned applications are incorporated by reference herein.

FIELD

The invention generally relates to ice skates, including their blade holder and their blade.

BACKGROUND

An ice skate includes a skate boot for receiving a skater's foot and a blade holder connecting a blade to the skate boot. Many different types of skate boots, blade holders and blades have been developed in order to provide skates which can accommodate different skating maneuvers as well as to provide certain benefits to skaters.

It is typically desirable from a skater's perspective to have a skate which is relatively lightweight. This is because heavier skates impose a larger physical burden during use and can incrementally result in tiring the skater.

While changes can be made to the skate boot itself, the skate boot can only be optimized to a certain point before reaching a substantial "plateau" in comfort, performance, production cost, etc. As such, it is important to also consider the design of the blade holder and the blade which can largely affect a skater's performance depending on the materials and design employed.

For these and/or other reasons, there is a need to improve ice skates, including their blade holder and/or their blade.

SUMMARY

In accordance with an aspect of the invention, there is provided a blade holder for an ice skate. The ice skate comprises a skate boot for receiving a foot of a skater. The blade holder comprises a blade-retaining base to retain a blade. The blade-retaining base comprises a first material. The blade holder comprises a support extending upwardly from the blade-retaining base to interconnect the blade holder and the skate boot. The support comprises a second material different from the first material.

In accordance with another aspect of the invention, there is provided a blade holder for an ice skate. The ice skate comprises a skate boot for receiving a foot of a skater. The blade holder comprises a blade-retaining base to retain a blade. The blade-retaining base comprises a non-composite material. The blade holder comprises a support extending upwardly from the blade-retaining base to interconnect the blade holder and the skate boot. The support comprises a composite material.

In accordance with another aspect of the invention, there is provided a blade holder for an ice skate. The ice skate comprises a skate boot for receiving a foot of a skater. The blade holder comprises a blade-retaining base to retain a blade. The blade-retaining base comprises a first material. The blade holder comprises a support extending upwardly from the blade-retaining base to interconnect the blade holder and the skate boot. The support comprises a second material stiffer than the first material.

In accordance with another aspect of the invention, there is provided a blade holder for an ice skate. The ice skate comprises a skate boot for receiving a foot of a skater. The blade holder comprises a blade-retaining base to retain a blade. The blade holder comprises a support extending upwardly from the blade-retaining base to interconnect the blade holder and the skate boot. At least part of the blade holder is made of a composite material and a ratio of a weight of the blade holder over a length of the blade holder is no more than 4.3 g/cm.

In accordance with another aspect of the invention, there is provided a blade holder for an ice skate. The ice skate comprises a skate boot for receiving a foot of a skater. The blade holder comprises a blade-retaining base to retain a blade. The blade-retaining base comprises a first material. The blade holder comprises a support extending upwardly from the blade-retaining base to interconnect the blade holder and the skate boot. The support comprises a second material different from the first material. The first material and the second material are mechanically interlocked.

In accordance with another aspect of the invention, there is provided a blade holder for an ice skate. The ice skate comprises a skate boot for receiving a foot of a skater. The blade holder comprises a blade-retaining base to retain a blade. The blade holder comprises a front pillar and a rear pillar extending upwardly from the blade-retaining base to interconnect the blade holder and the skate boot. Each of the front pillar and the rear pillar comprises: a wall defining a cavity and comprising a composite material; and a peripheral opening that leads to the cavity such that the cavity is exposed from an exterior of the skate when the blade holder is mounted to the skate boot.

In accordance with another aspect of the invention, there is provided a blade holder for an ice skate. The ice skate comprises a skate boot for receiving a foot of a skater. The blade holder comprises a blade-retaining base to retain a blade. The blade-retaining base comprises a first material. The blade holder comprises a support extending upwardly from the blade-retaining base to interconnect the blade holder and the skate boot. The support comprises a second material stiffer than the first material. The blade holder comprises a blade-detachment mechanism such that the blade is selectively detachable and removable from, and attachable to, the blade holder. The blade-detachment mechanism is disposed in a cavity defined by a wall at least partly made of the first material.

In accordance with another aspect of the invention, there is provided a method of manufacturing a blade holder for an ice skate. The ice skate comprises a skate boot for receiving a foot of a skater. The method comprises: providing a first material and a second material different from the first material; and processing the first material and the second material to form (i) a blade-retaining base to retain a blade and (ii) a support extending upwardly from the blade-retaining base to interconnect the blade holder and the skate boot. The blade-retaining base comprises the first material and the support comprises the second material.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the following drawings, in which.

Figure 1:
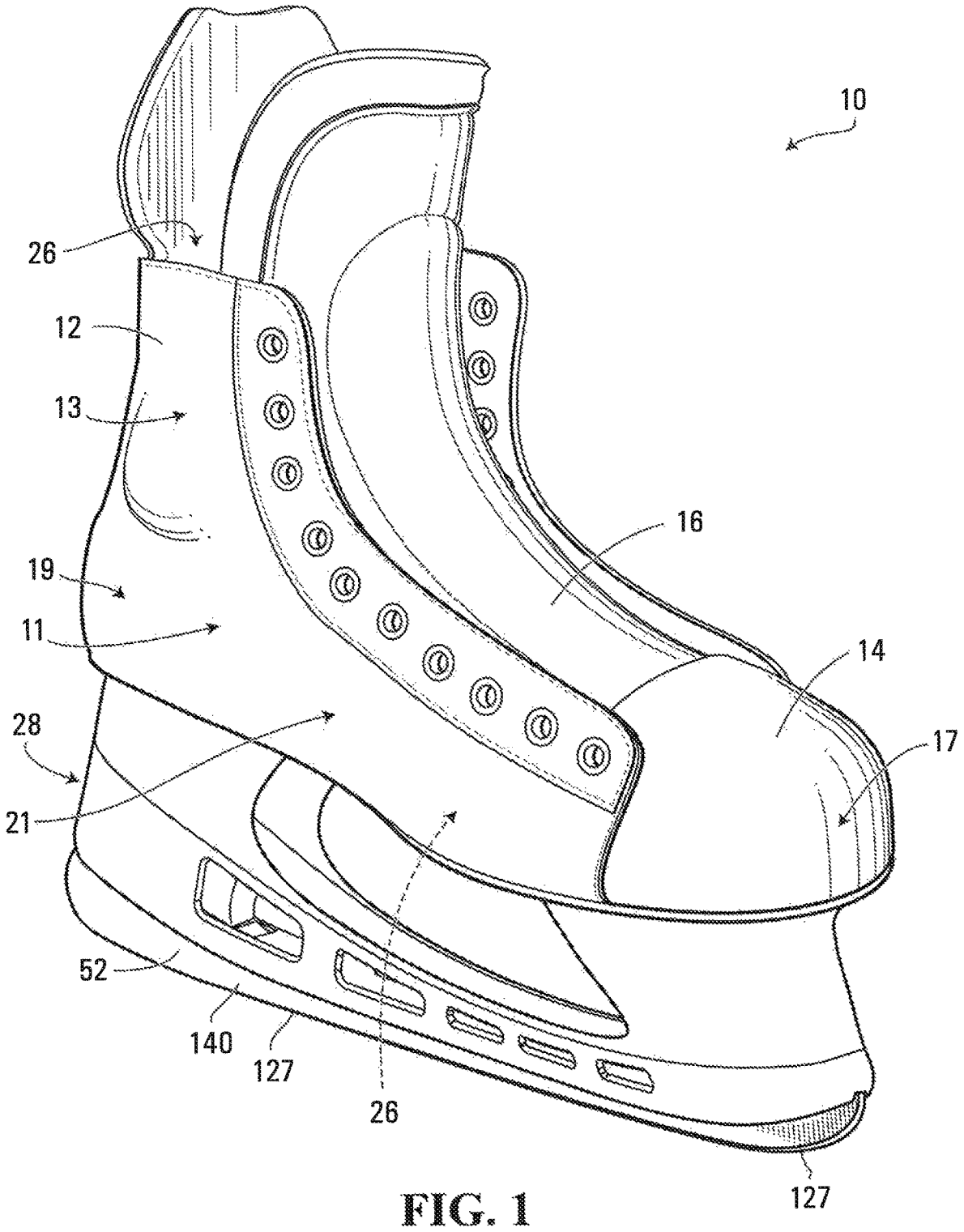
FIG. 1 is a perspective view of an example of an ice skate in accordance with an embodiment of the invention.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF EMBODIMENTS

Figure 2:
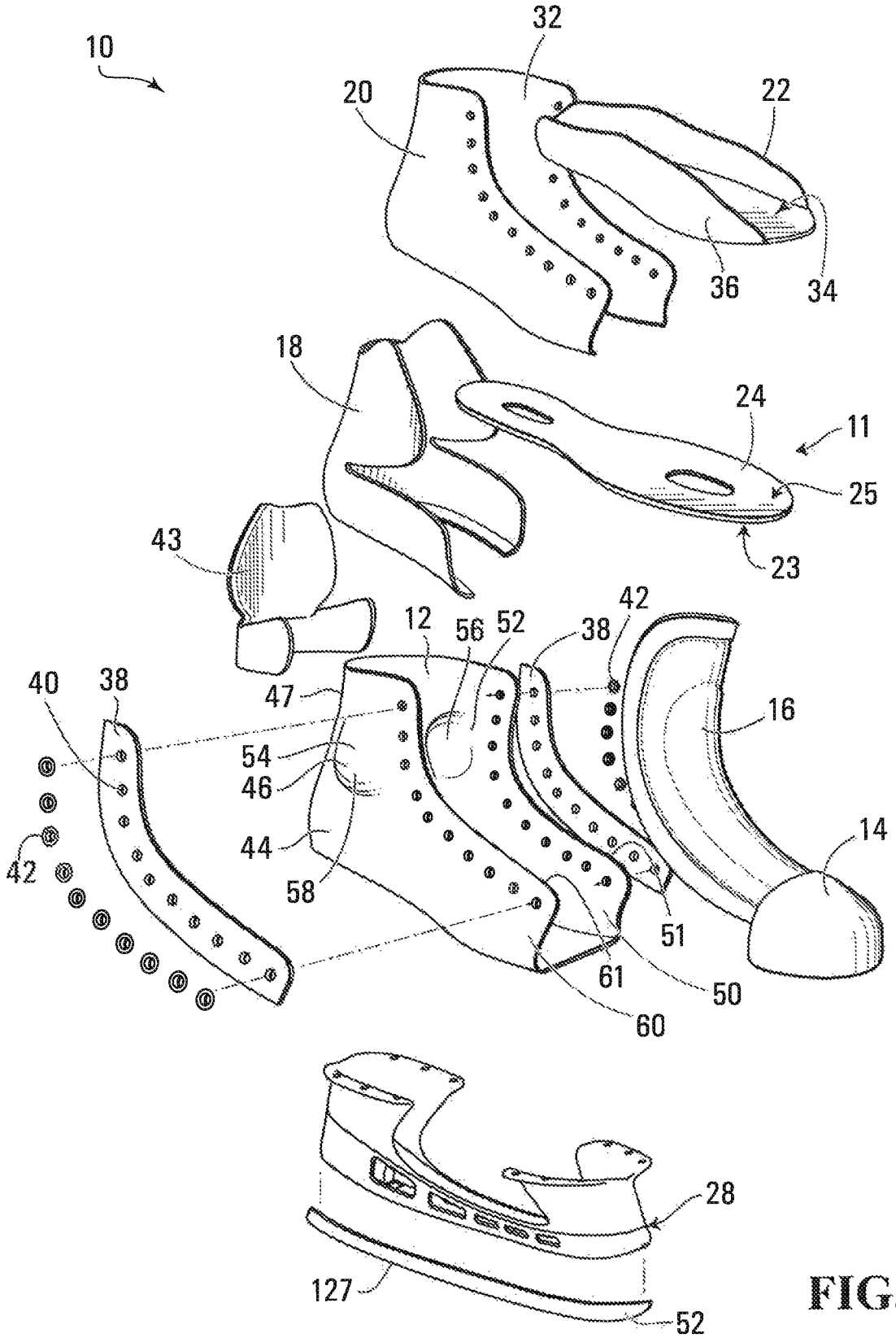
FIG. 2 is an exploded view of the ice skate, including a skate boot, a blade holder, and a blade of the ice skate.
Figure 3:
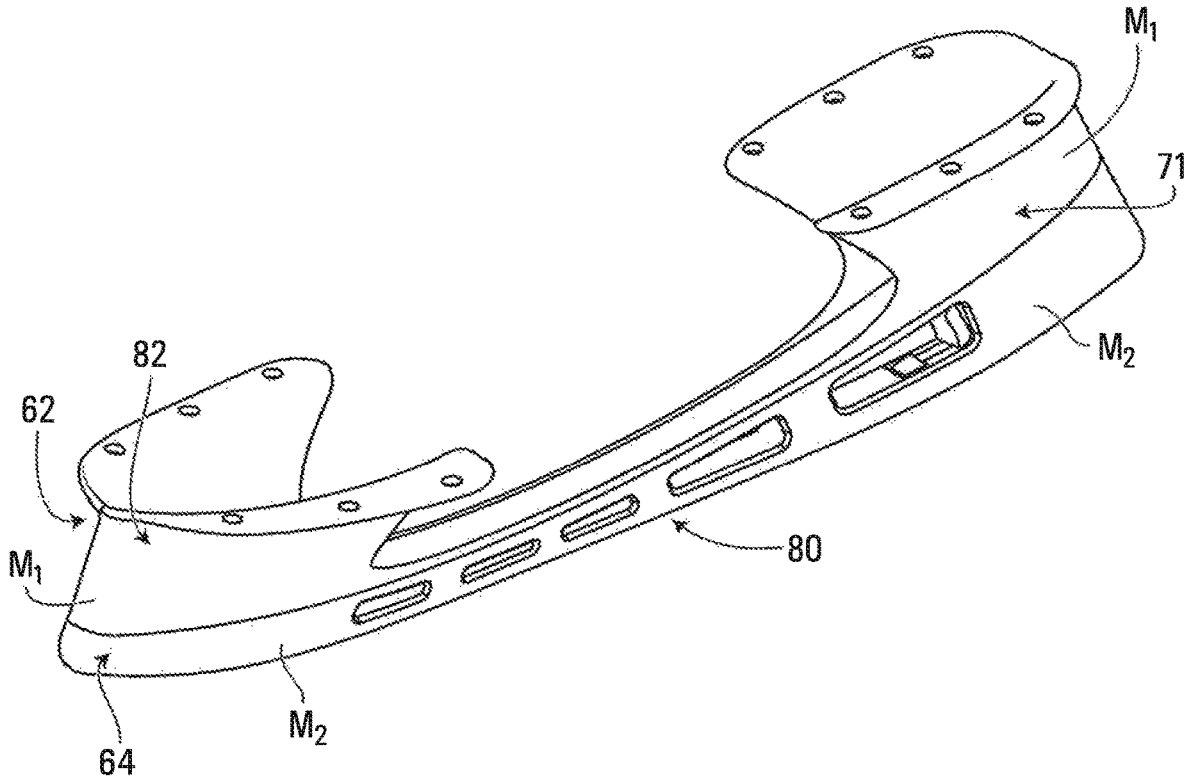
FIGS. 3 to 8 are various views of the blade holder.
Figure 4:
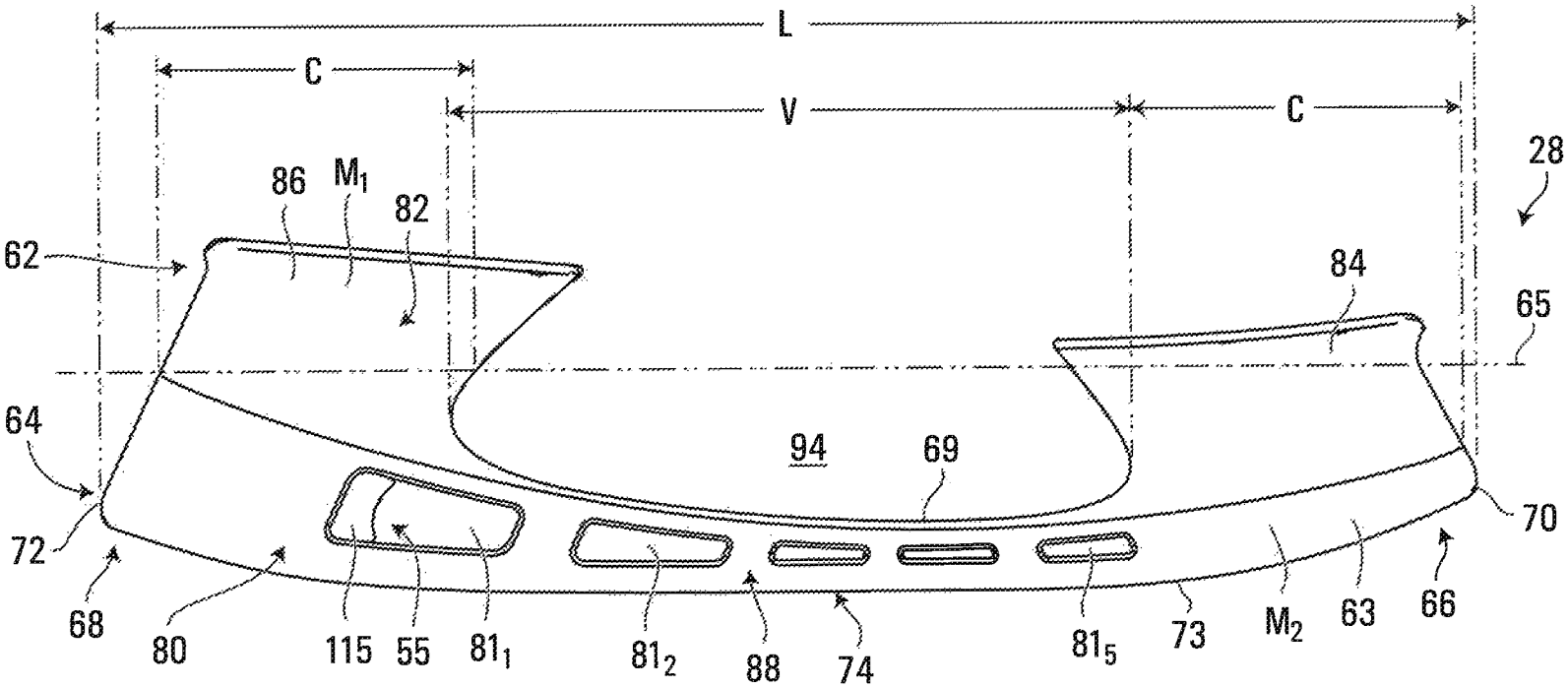
Figure 5:
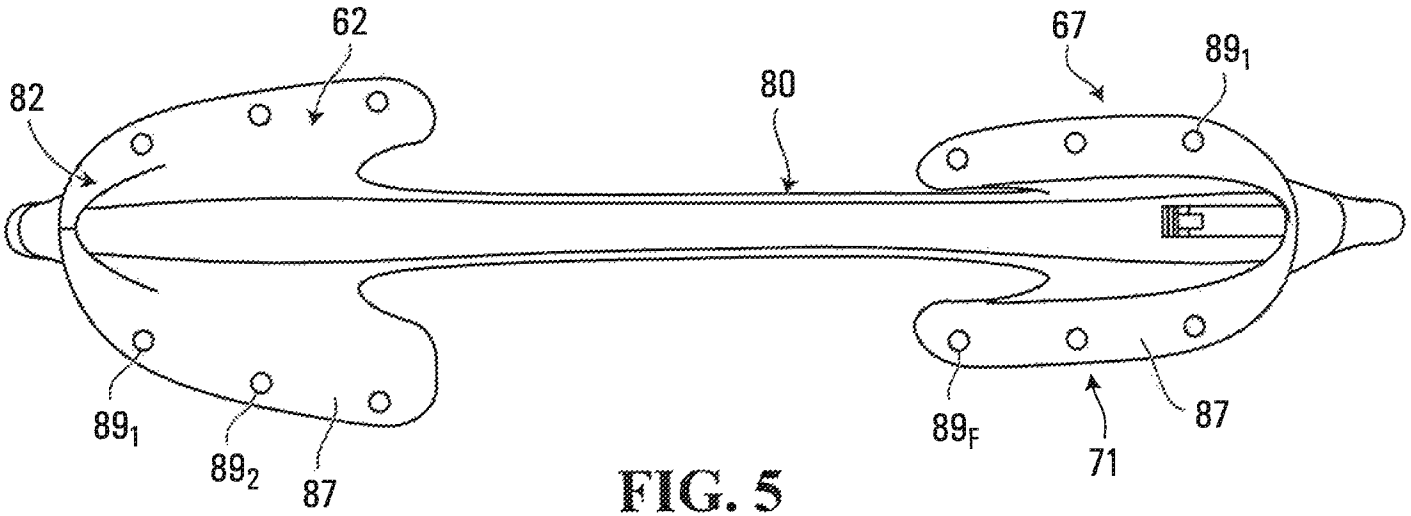
Figure 6:
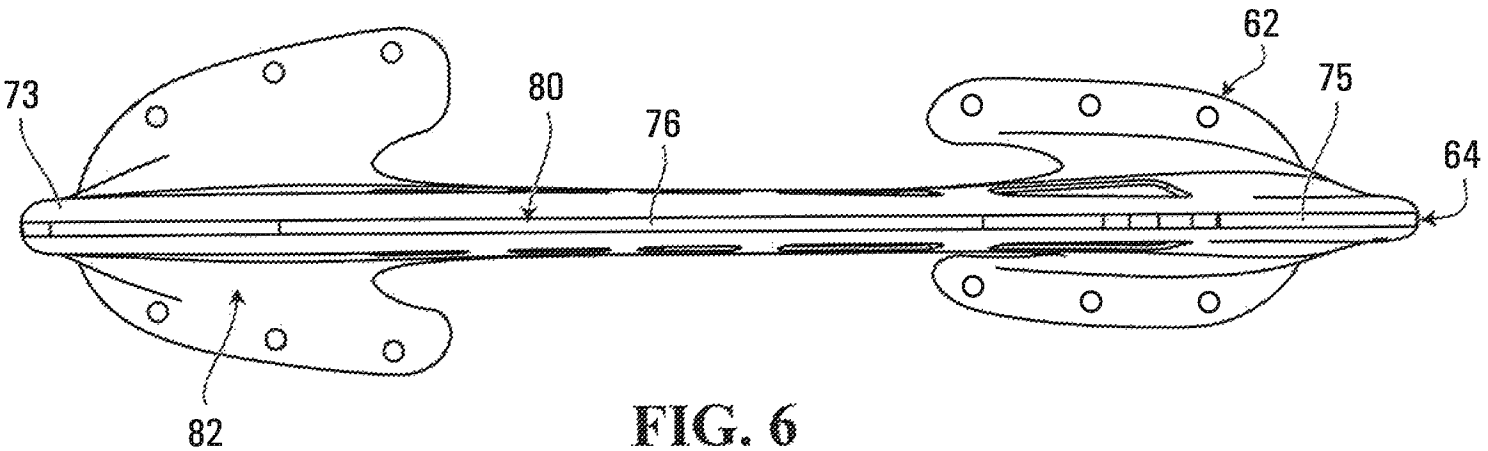
Figure 7:
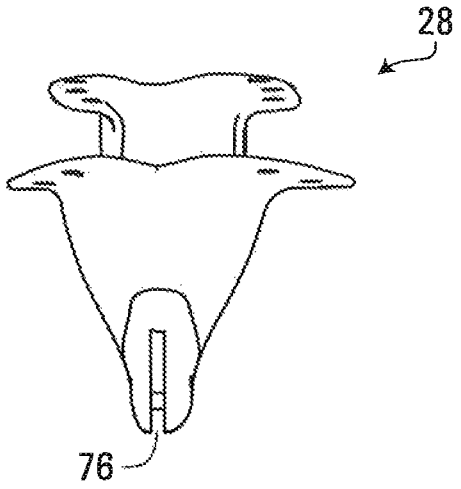
Figure 8:
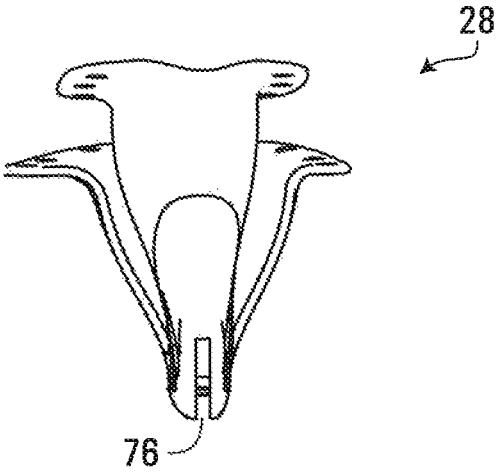
Figure 9:
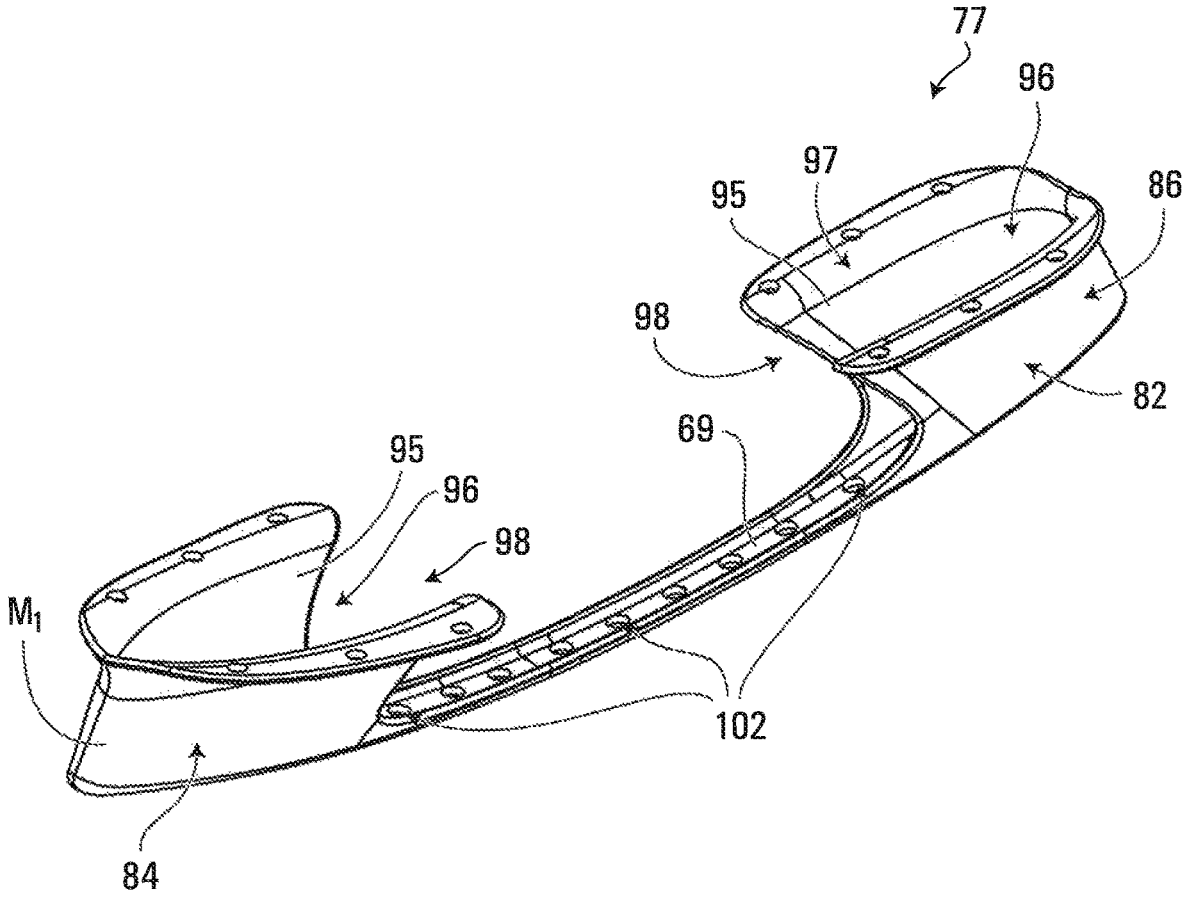
FIGS. 9 to 14 are various views of an upper component of the blade holder.
Figure 10:
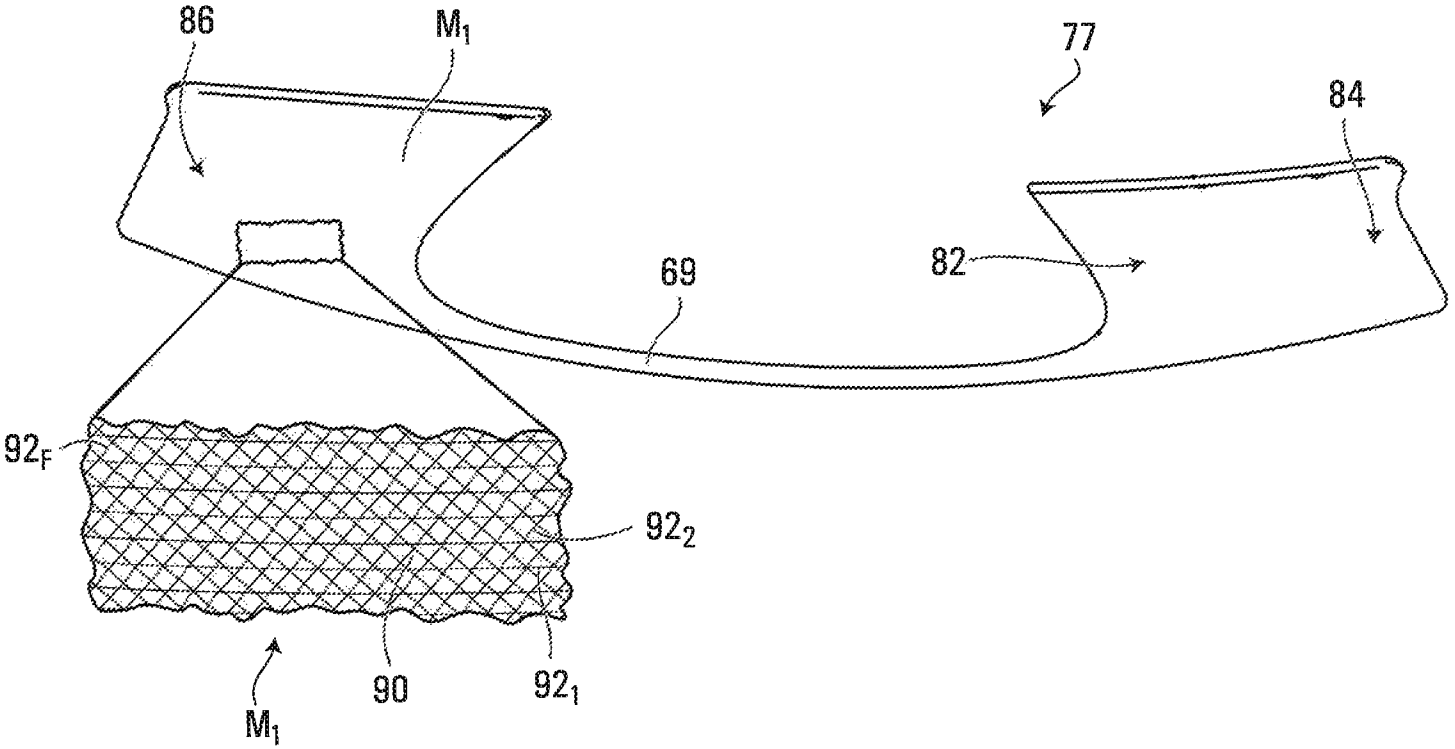
Figure 11:
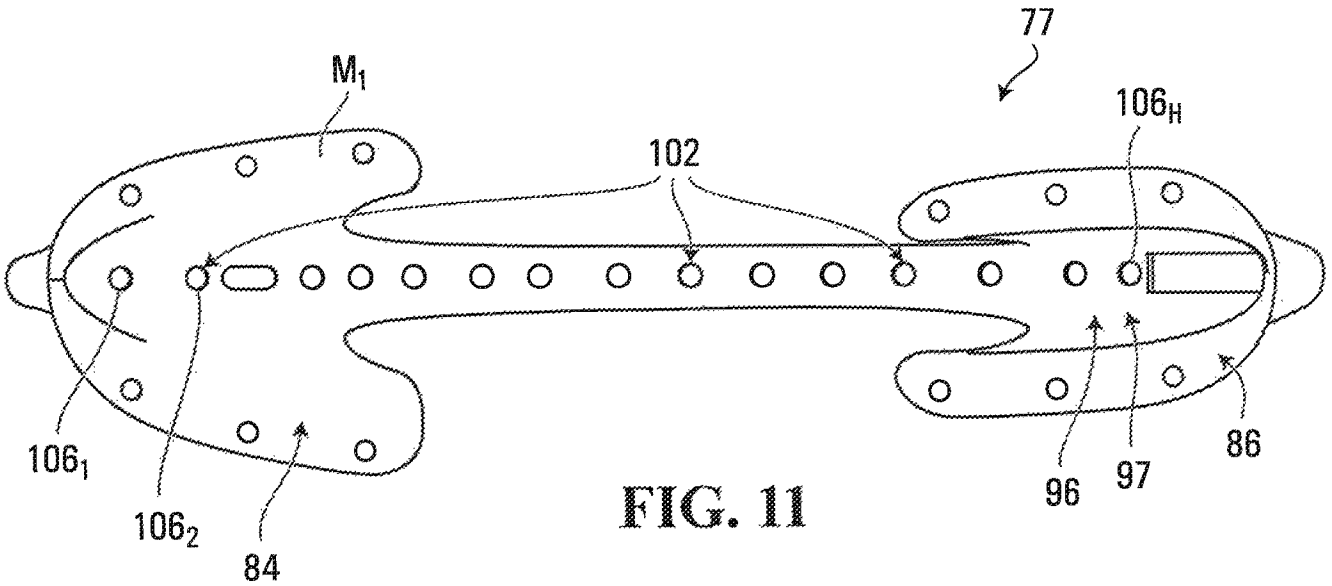
Figure 12:
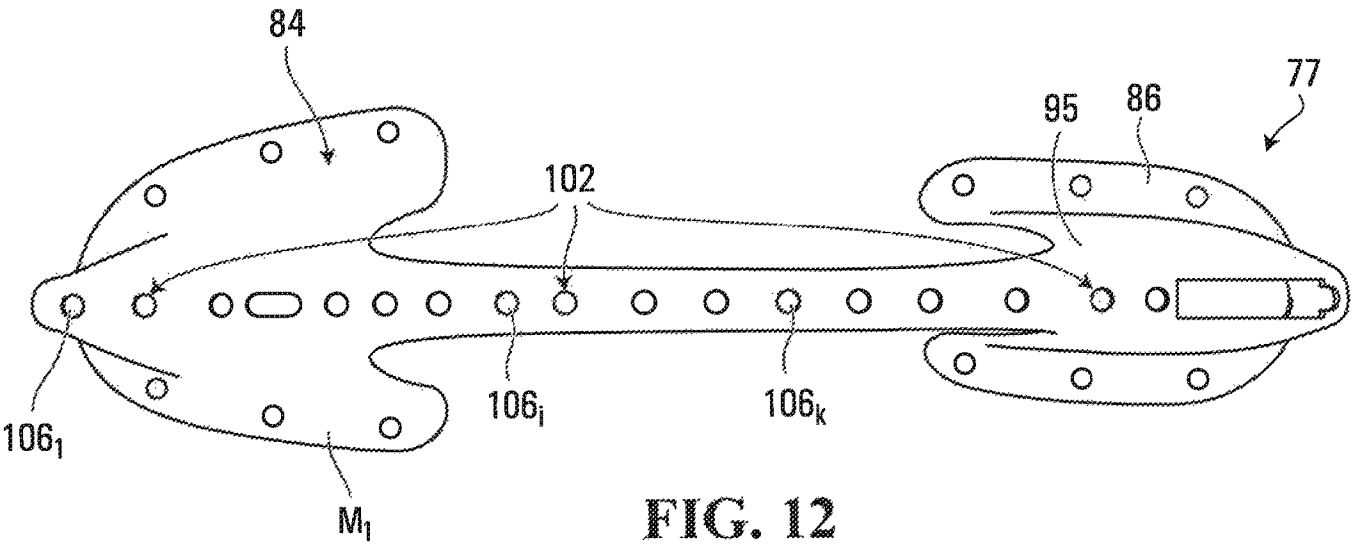
Figure 13:
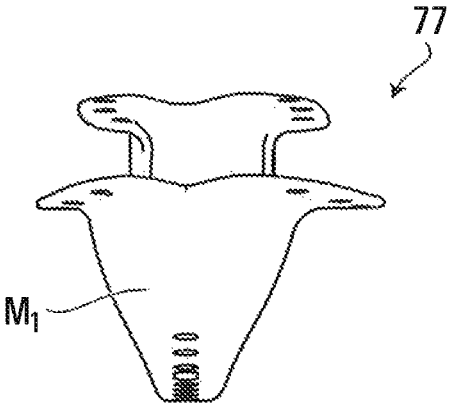
Figure 14:
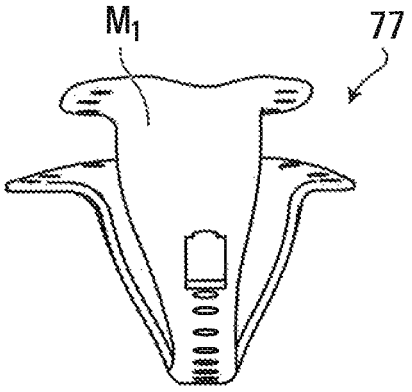
Figure 15:
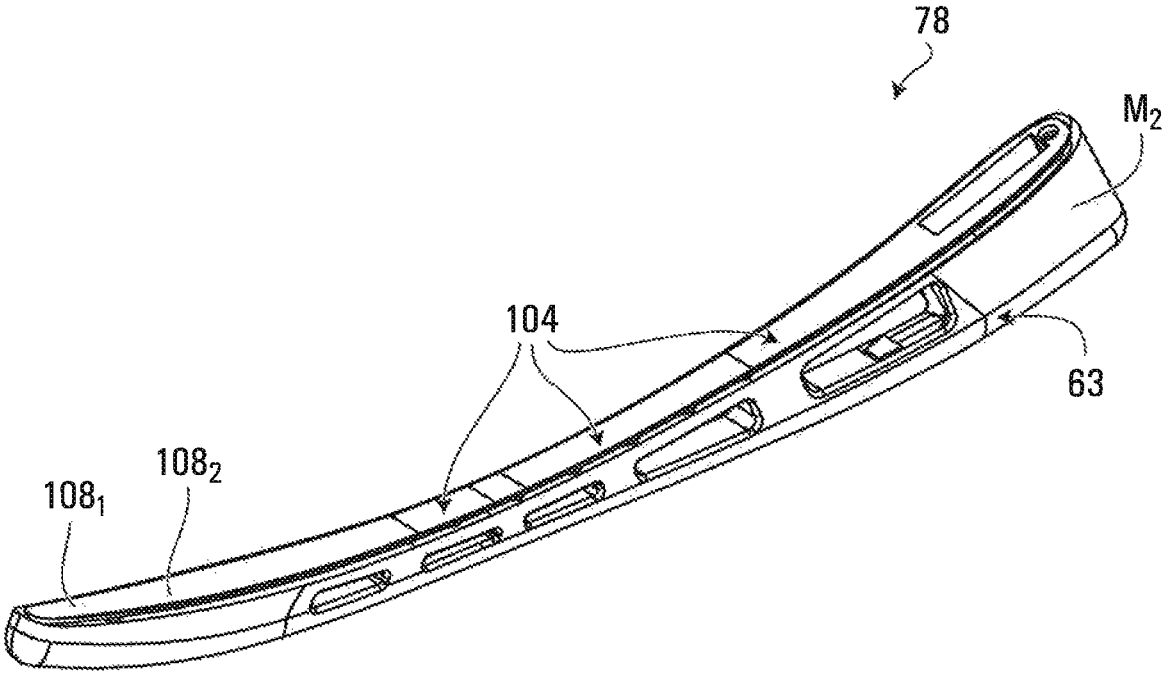
FIGS. 15 to 20 are various views of a lower component of the blade holder.
Figure 16:
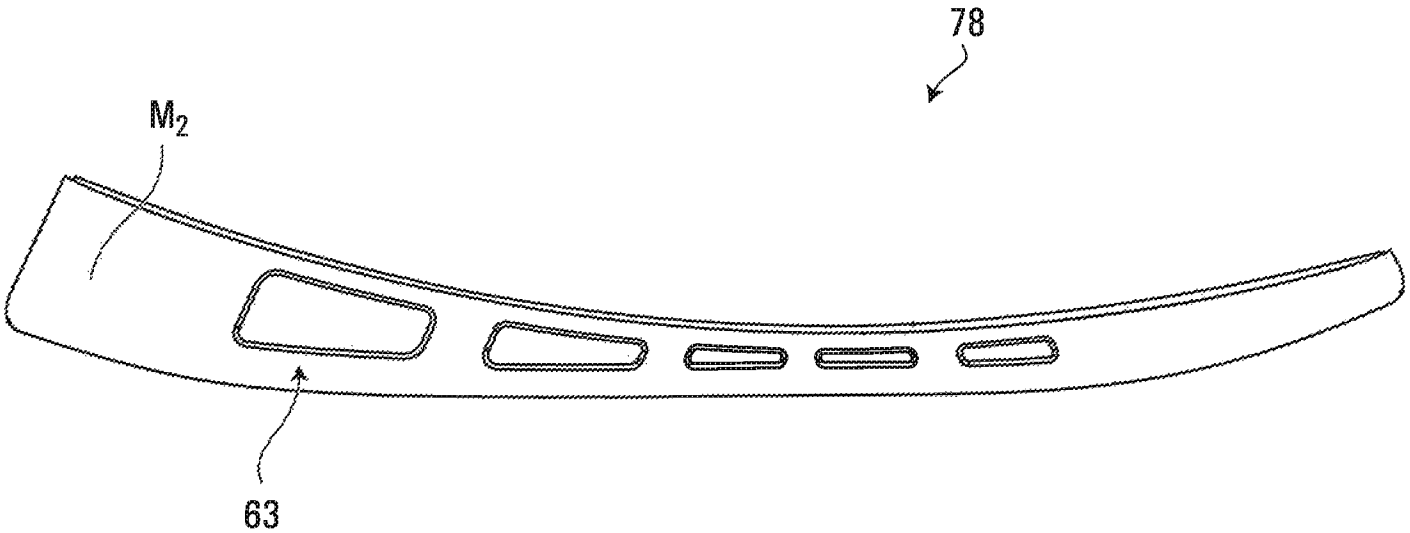
Figure 17:
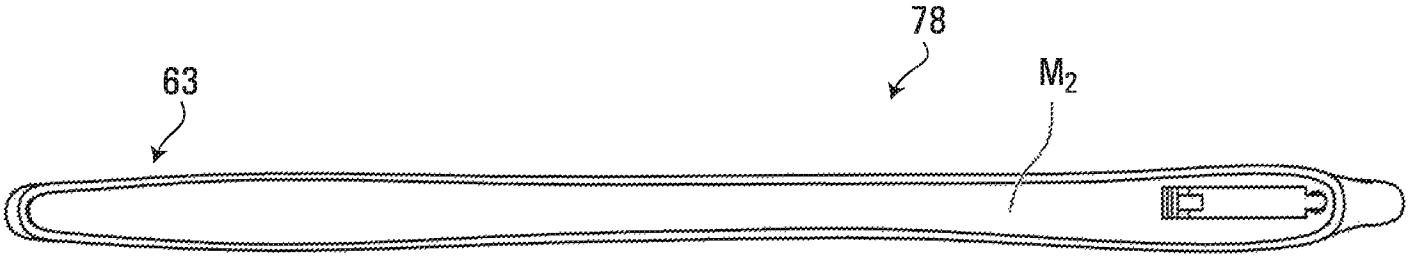
Figure 18:
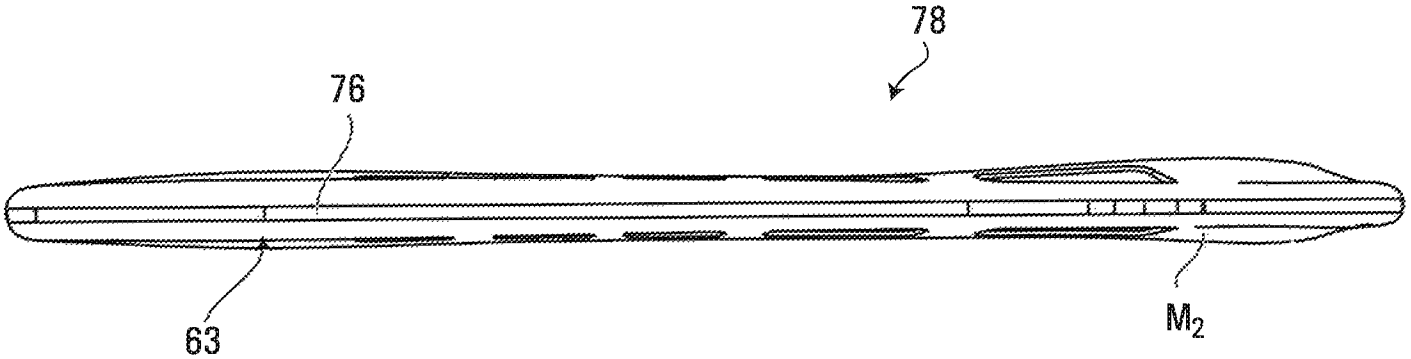
Figure 19:
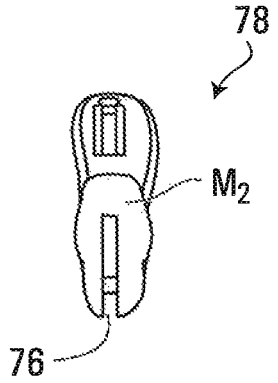
Figure 20:
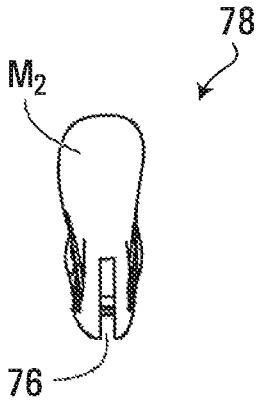

FIGS. 1 and 2 show an example of an ice skate 10 in accordance with an embodiment of the invention. The ice skate 10 comprises a skate boot 11 for enclosing a skater's foot, a blade holder 28, and a blade 52 for contacting an ice surface on which the skater skates. In this embodiment, the ice skate 10 is a hockey skate designed for playing ice hockey. In other embodiments, the ice skate 10 may be designed for other types of skating activities.

As further discussed below, the ice skate 10, including the blade holder 28, is lightweight and may provide other performance benefits to the skater. For example, in this embodiment, the blade holder 28 is designed to optimize its weight and performance characteristics, including greater stiffness in certain areas (e.g., front and heel areas) and greater feel and control in other areas (e.g., along an interface with the blade 52). For instance, in this embodiment, the blade holder 28 comprises an arrangement of different materials (e.g., a composite material and a polymeric material) that differ in stiffness and density and are strategically distributed in the blade holder 28.

Figure 40:
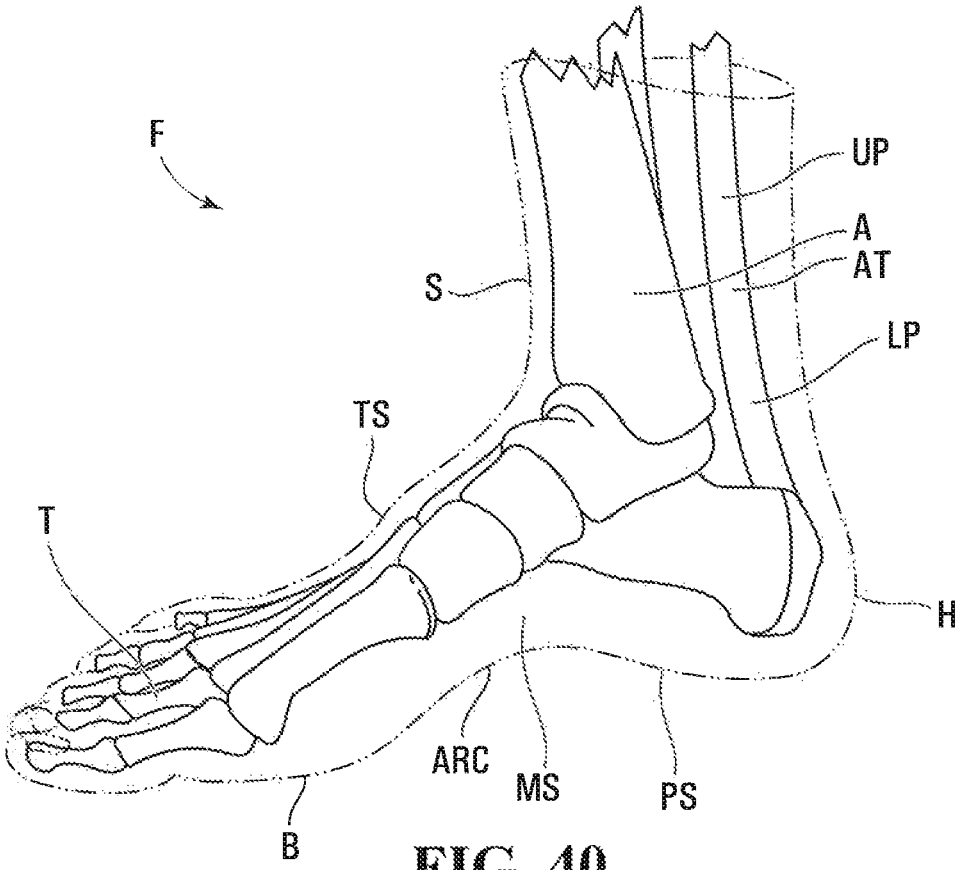
FIGS. 40 and 41 are side and front views of a right foot of a wearer of the ice skate with an integument of the foot shown in dotted lines and bones shown in solid lines.
Figure 41:
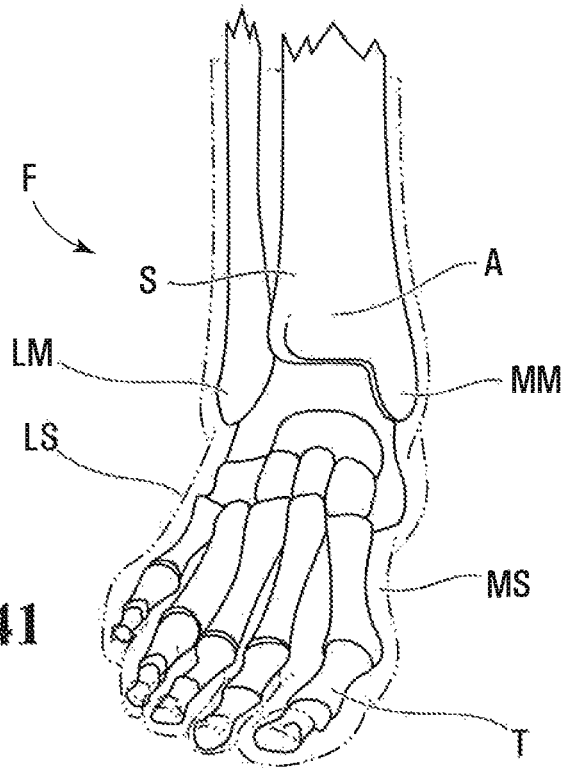

The skate boot 11 defines a cavity 26 for receiving the skater's foot. With additional reference to FIGS. 40 and 41, the skater's foot includes toes T, a ball B, an arch ARC, a plantar surface PS, a top surface TS, a medial side MS and a lateral side LS. The top surface TS of the skater's foot is continuous with a lower portion of the skater's shin S. In addition, the skater has a heel H, an Achilles tendon AT, and an ankle A having a medial malleolus MM and a lateral malleolus LM that is at a lower position than the medial malleolus MM. The Achilles tendon AT has an upper part UP and a lower part LP projecting outwardly with relation to the upper part UP and merging with the heel H. A forefoot of the skater includes the toes T and the ball B, a hindfoot of the skater includes the heel H, and a midfoot of the skater is between the forefoot and midfoot.

In this embodiment, the skate boot 11 comprises a front portion 17 for receiving the toes T of the skater's foot, a rear portion 19 for receiving the heel H of the skater's foot, and an intermediate portion 21 between the front portion 17 and the rear portion 19.

More particularly, in this embodiment, the skate boot 11 comprises an outer shell 12, a toe cap 14 for facing the toes T, a tongue 16 extending upwardly and rearwardly from the toe cap 14 for covering the top surface TS of the skater's foot, a rigid insert 18 for providing more rigidity around the ankle A and the heel H of the skater's foot, an inner lining 20, a footbed 22, and an insole 24. The skate boot 11 also comprises lace members 38 and eyelets 42 punched into the lace members 38, the outer shell 12 and the inner lining 20 vis-à-vis apertures 40 in order to receive laces for tying on the skate 10.

The inner lining 20 is affixed to an inner surface of the outer shell 12 and comprises an inner surface 32 intended for contact with the heel H and medial and lateral sides MS, LS of the skater's foot and the skater's ankle A in use. The inner lining 20 may be made of a soft material (e.g., a fabric made of NYLON® fibers or any other suitable fabric). The rigid insert 18 is sandwiched between the outer shell 12 and the inner lining 20 and may be affixed in any suitable way (e.g., glued to the inner surface of the outer shell 12 and stitched along its periphery to the outer shell 12). The footbed 22 is mounted inside the outer shell 12 and comprises an upper surface 34 for receiving the plantar surface PS of the skater's foot and a wall 36 projecting upwardly from the upper surface 34 to partially cup the heel H and extend up to a medial line of the skater's foot. The insole 24 has an upper surface 25 for facing the plantar surface PS of the skater's foot and a lower surface 23 on which the outer shell 12 may be affixed.

The outer shell 12 is molded (e.g., thermoformed) such that it comprises a heel portion 44 for receiving the heel H, an ankle portion 46 for receiving the ankle A, and medial and lateral side portions 50, 60 for facing the medial and lateral sides MS, LS of the skater's foot, respectively. The medial and lateral side portions 50, 60 include upper edges 51, 61 which connect to the lace members 38. The heel portion 44 may be formed such that it is substantially cup-shaped for following the contour of the heel H. The ankle portion 46 comprises medial and lateral ankle sides 52, 54. The medial ankle side 52 has a medial cup-shaped depression 56 for receiving the medial malleolus MM and the lateral ankle side 54 has a lateral cup-shaped depression 58 for receiving the lateral malleolus LM of the skater. The lateral depression 58 is located slightly lower than the medial depression 56, for conforming to the morphology of the skater's foot. The ankle portion 46 further comprises a rear portion 47 facing the lower part LP of the Achilles tendon AT. The rear portion 47 may be thermoformed such that it follows the lower part LP of the Achilles tendon AT. Furthermore, the skate boot 11 also includes a tendon guard 43 affixed to the rear portion 47 of the ankle portion 46 and extending upwardly therefrom.

The skate boot 11 may be constructed in any other suitable way in other embodiments. For example, in other embodiments, various components of the skate boot 11 mentioned above may be configured differently or omitted and/or the skate boot 11 may comprise any other components that may be made of any other suitable materials and/or using any other suitable processes.

With additional reference to FIGS. 3 to 8, the blade holder 28 comprises a lower portion 64 comprising a blade-retaining base 80 that retains the blade 52 and an upper portion 62 comprising a support 82 that extends upwardly from the blade-retaining base 80 towards the skate boot 11 to interconnect the blade holder 28 and the skate boot 11. A front portion 66 of the blade holder 28 and a rear portion 68 of the blade holder 28 define a longitudinal axis 65 of the blade holder 28. The front portion 66 of the blade holder 28 includes a frontmost point 70 of the blade holder 28 and extends beneath and along the skater's forefoot in use, while the rear portion 68 of the blade holder 28 includes a rearmost point 72 of the blade holder 28 and extends beneath and along the skater's hindfoot in use. An intermediate portion 74 of the blade holder 28 is between the front and rear portion 66, 68 of the blade holder 28 and extends beneath and along the skater's midfoot in use. A length L of the blade holder 28 can be measured from the frontmost point 70 to the rearmost point 72. The blade holder 28 comprises a medial side 71 and a lateral side 67 that are opposite one another. The blade holder 28 has a longitudinal direction (i.e., a direction generally parallel to its longitudinal axis 65) and transversal directions (i.e., directions transverse to its longitudinal axis 65), including a widthwise direction (i.e., a lateral direction generally perpendicular to its longitudinal axis 65). The blade holder 28 also has a height direction normal to its longitudinal and widthwise directions.

The blade-retaining base 80 is elongated in the longitudinal direction of the blade holder 28 and is configured to retain the blade 52 such that the blade 52 extends along a bottom portion 73 of the blade-retaining base 80 to contact the ice surface. To that end, the blade-retaining base 80 comprises a blade-retention portion 75 to face and retain the blade 52. In this embodiment, the blade-retention portion 75 comprises a recess 76 in which an upper portion of the blade 52 is disposed.

Figure 21A:
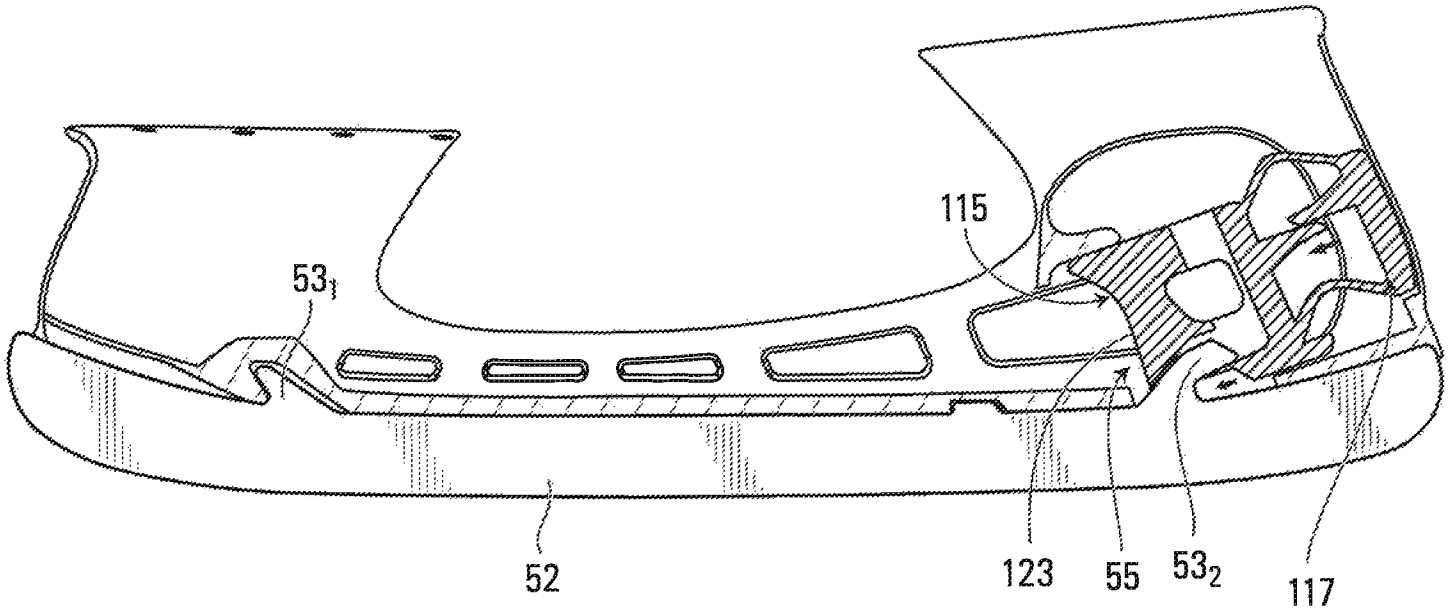
FIGS. 21A to 21C are partial cross-sectional views showing a blade-detachment mechanism of the blade holder.
Figure 21B:
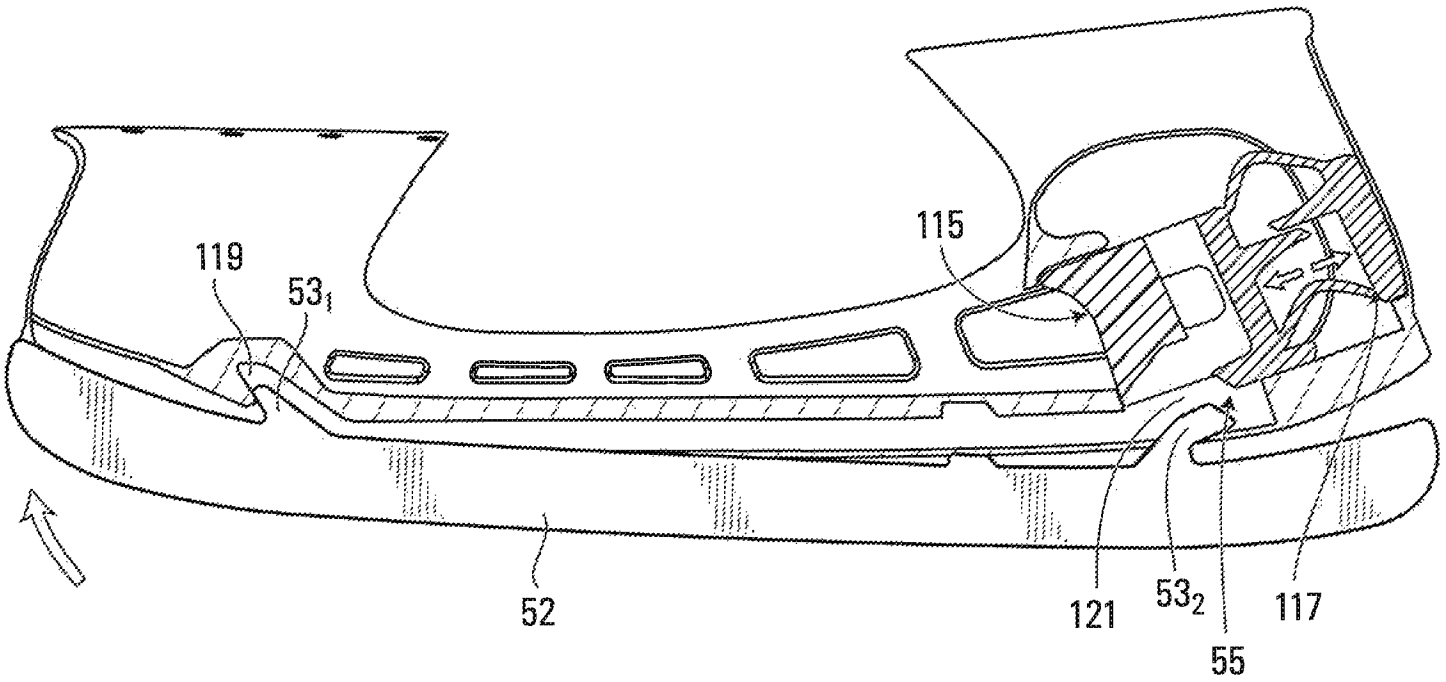
Figure 21C:
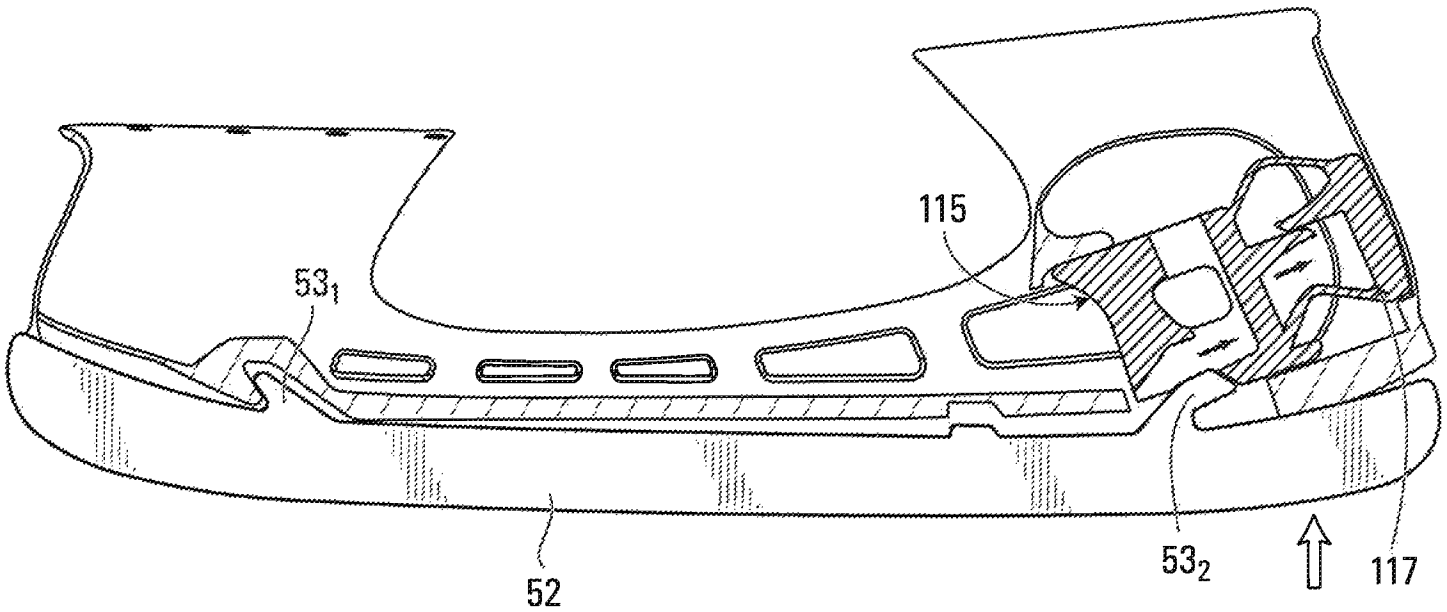
Figure 22:
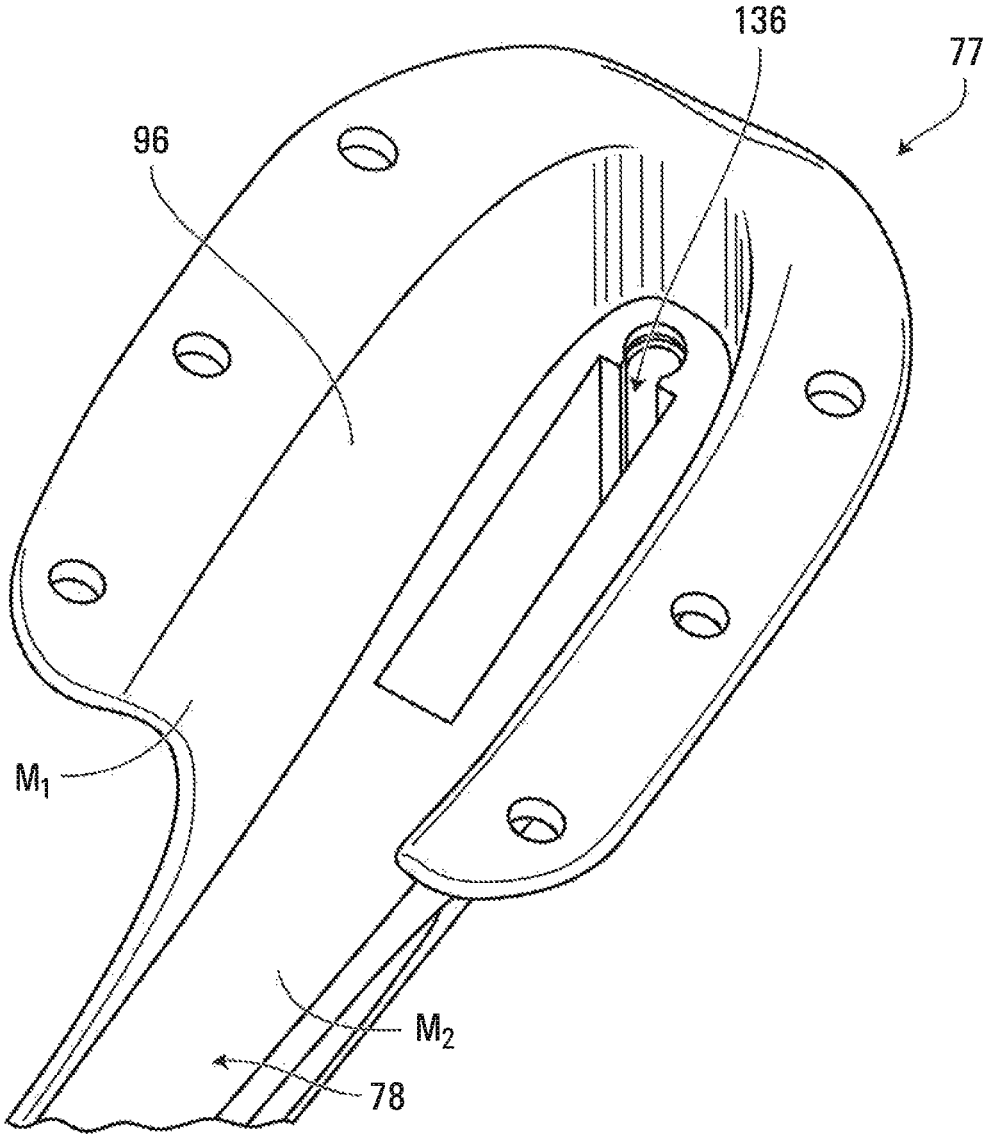
FIGS. 22 to 26 show various views of different parts of the blade holder, including an interconnection of these different parts of the blade holder.
Figure 23:
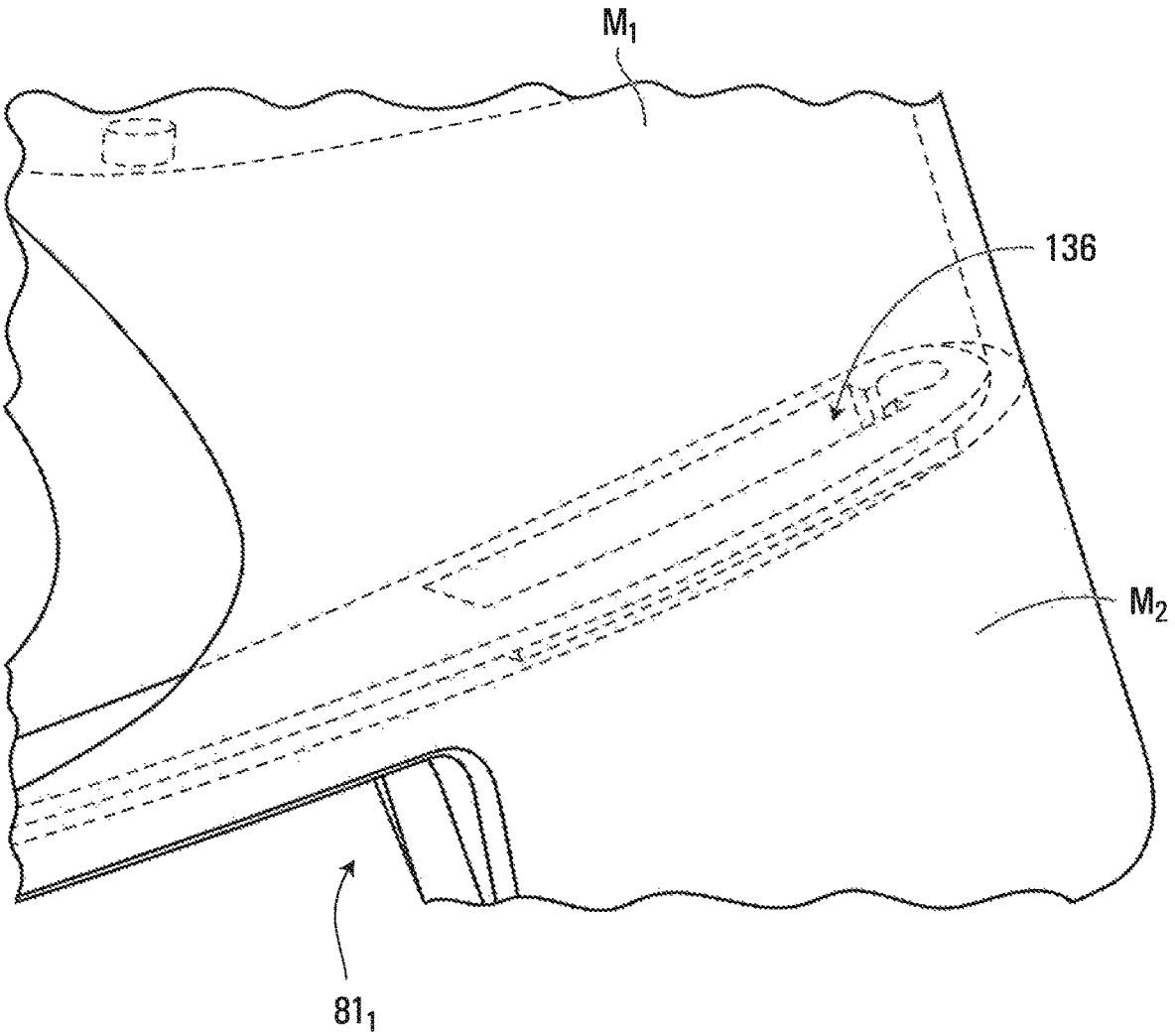
Figure 24:
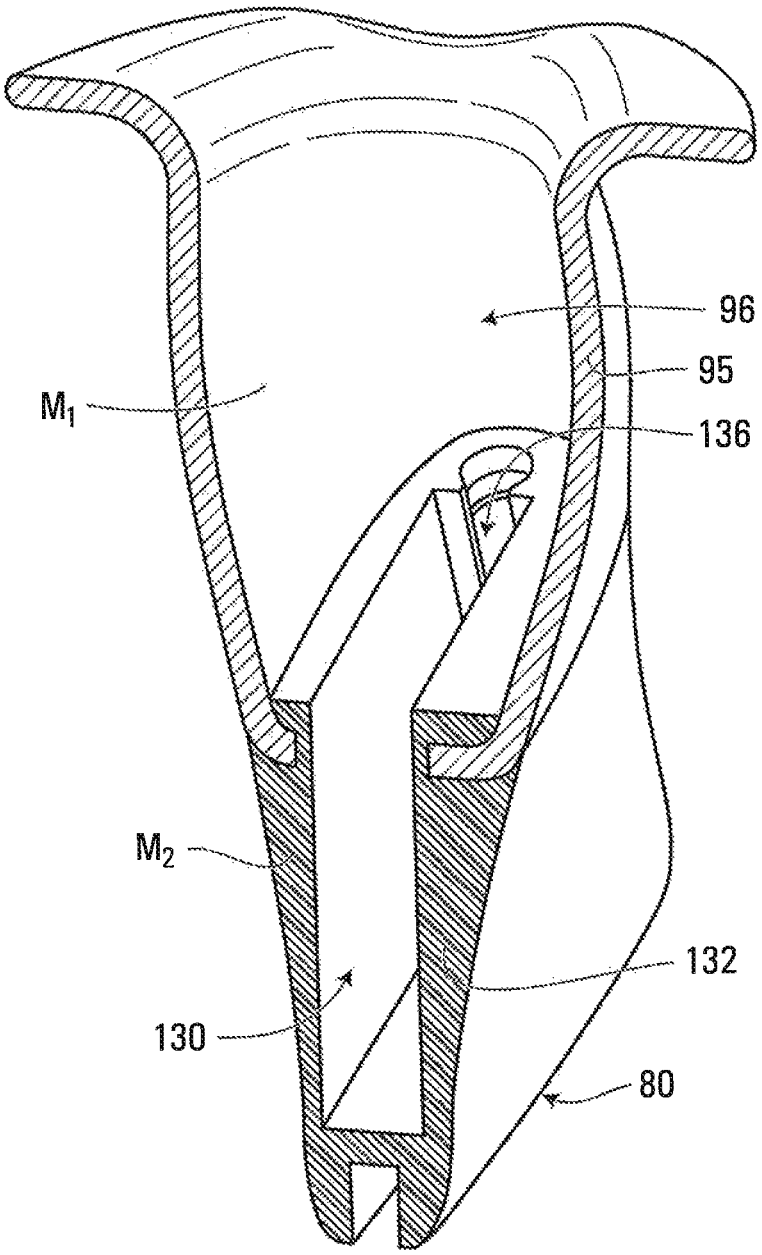
Figure 25:
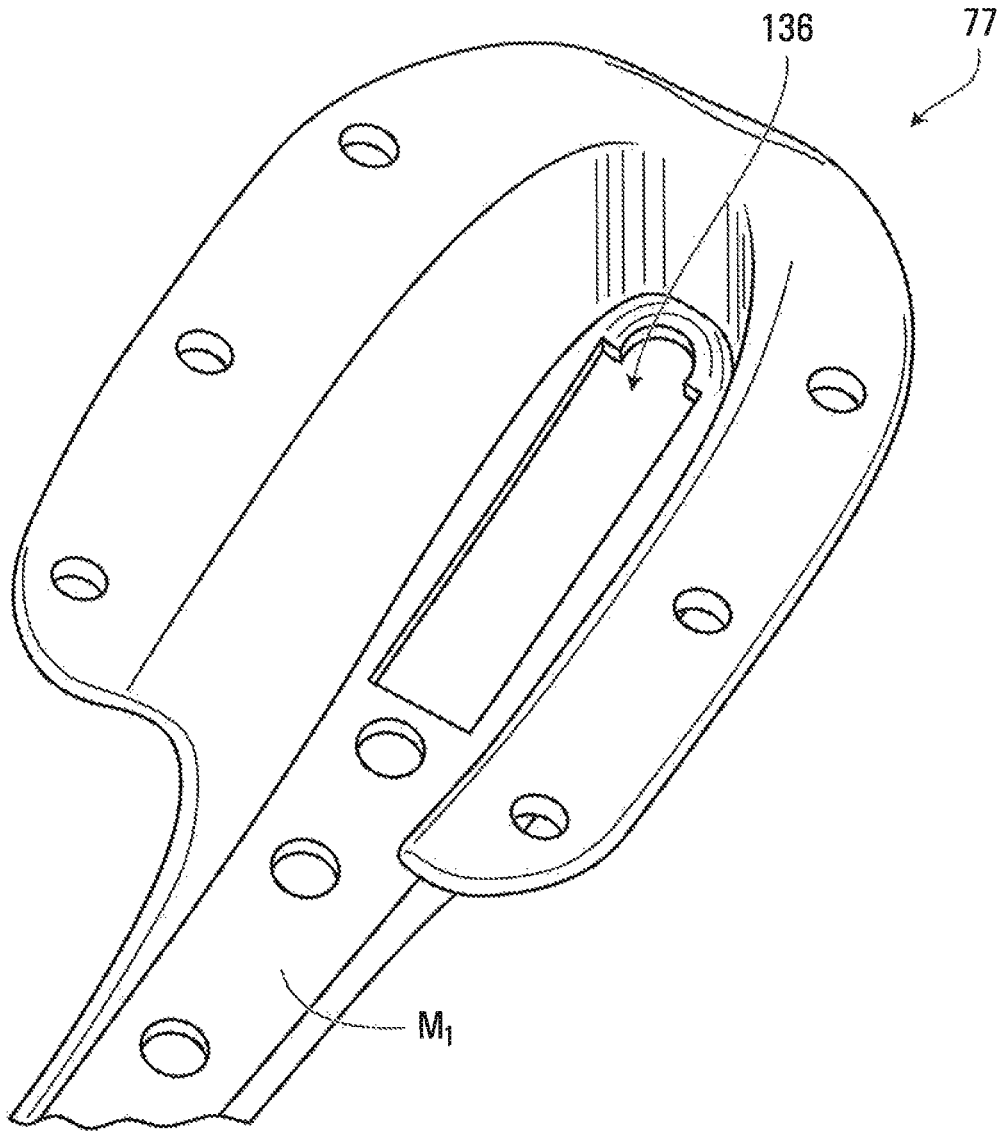

The blade holder 28 can retain the blade 52 in any suitable way. In this embodiment, with additional reference to FIGS. 21A to 21C, the blade holder 28 comprises a blade-detachment mechanism 55 such that the blade 52 is selectively detachable and removable from, and attachable to, the blade holder 28 (e.g., when the blade 52 is worn out or otherwise needs to be replaced or removed from the blade holder 28). More particularly, in this embodiment, the blade 52 includes a plurality of projections $\mathbf{53}_1$, $\mathbf{53}_2$. The blade-detachment mechanism 55 includes an actuator 115 and a biasing element 117 which biases the actuator 115 in a direction towards the front portion 66 of the blade holder 28. To attach the blade 52 to the blade holder 28, the front projection $\mathbf{53}_1$ is first positioned within a hollow space 119 (e.g., a recess or hole) of the blade holder 28. The rear projection $\mathbf{53}_2$ can then be pushed upwardly into a hollow space 121 (e.g., a recess or hole) of the blade holder 28, thereby causing the biasing element 117 to bend and the actuator 115 to move in a rearward direction. The rear projection $\mathbf{53}_2$ will eventually reach a position which will allow the biasing element 117 to force the actuator 115 towards the front portion 66 of the blade holder 28, thereby locking the blade 52 in place. The blade 52 can then be removed by pushing against a finger-actuating surface 123 of the actuator 115 to release the rear projection $\mathbf{53}_2$ from the hollow space 121 of the blade holder 28. Further information on examples of implementation of the blade-detachment mechanism 55 in some embodiments may be obtained from U.S. Pat. No. 8,454,030 hereby incorporated by reference herein. The blade-detachment mechanism 55 may be configured in any other suitable way in other embodiments.

In this embodiment, the blade-retaining base 80 comprises a plurality of apertures $\mathbf{81}_1$-$\mathbf{81}_5$ distributed in the longitudinal direction of the blade holder 28 and extending from the medial side 71 to the lateral side 67 of the blade holder 28. In this example, respective ones of the apertures $\mathbf{81}_1$-$\mathbf{81}_5$ differ in size. More particularly, in this example, the apertures $\mathbf{81}_1$-$\mathbf{81}_5$ decrease in size towards the front portion of the blade holder 66. The apertures $\mathbf{81}_1$-$\mathbf{81}_5$ may have any other suitable configuration, or may be omitted, in other embodiments.

The blade-retaining base 80 may be configured in any other suitable way in other embodiments.

The support 82 is configured for supporting the skate boot 11 above the blade-retaining base 80 and transmit forces to and from the blade-retaining base 80 during skating. In this embodiment, the support 82 comprises a front pillar 84 and a rear pillar 86 which extend upwardly from the blade-retaining base 80 towards the skate boot 11. The front pillar 84 extends towards the front portion 17 of the skate boot 11 and the rear pillar 86 extends towards the rear portion 19 of the skate boot 11. The blade-retaining base 80 extends from the front pillar 84 to the rear pillar 86. More particularly, in this embodiment, the blade-retaining base 80 comprises a bridge 88 interconnecting the front and rear pillars 84, 86

The support 82 and the skate boot 11 can be connected to one another in any suitable way. In this embodiment, the support 82 is affixed to the skate boot 11.

More particularly, in this embodiment, the front and rear pillars 84, 86 are fastened to the skate boot 11 by fasteners (e.g., rivets, screws, bolts). In this example, each of the front and rear pillars 84, 86 comprises a flange 87 including a plurality of apertures $\mathbf{89}_1$-$\mathbf{89}_F$ to receive respective ones of the fasteners that fasten the blade holder 28 to the skate boot 11. The support 82 may be affixed to the skate boot 11 in any other suitable manner in other embodiments (e.g., by an adhesive).

The support 82 may be configured in any other suitable way apertures $\mathbf{81}_1$-$\mathbf{81}_5$ in other embodiments.

In this embodiment, the blade holder 28 is characterized by a material distribution profile to optimize its weight and performance characteristics. Notably, in this embodiment, the material distribution profile of the blade holder 28 results in a variation in density and a variation in rigidity across certain areas of the blade holder 28 to reduce its weight while providing greater stiffness in some areas (e.g., the front and rear pillars 84, 86) where more rigidity may be desirable (e.g., to better transmit forces) and greater compliance (i.e., less stiffness) in other areas (e.g., along the blade-retaining base 80) where less rigidity may be desirable (e.g., for better feel and control).

The material distribution profile is designed such that the blade holder 28 comprises an arrangement of different materials $M_1$, $M_2$ disposed in selected areas of the blade holder 28. The different materials $M_1$, $M_2$ belong to different classes of materials (i.e., polymers, metals, ceramics and composites) and/or exhibit substantially different values of a given material property (e.g., modulus of elasticity, tensile strength, density, etc.).

In this embodiment, the material $M_1$ is stiffer (i.e., more rigid) than the material $M_2$ and makes up at least a major part (i.e., a major part or an entirety) of the support 82 of the upper portion 62 of the blade holder 28, while the material $M_2$ makes up at least a major part of the blade-retaining base 80 of the lower portion 64 of the blade holder 28. More particularly, in this embodiment, the material $M_1$ makes up at least a major part of each of the front and rear pillars 84, 86 and the material $M_2$ makes up at least a major part of the blade-retaining base 80. This makes the front and rear pillars 84, 86 of the blade holder 28 stiffer, which may better transmit forces and provide more strength during skating, while making the blade-retaining base 80 less stiff, which may allow for better feel and control during skating.

More particularly, in this embodiment, with additional reference to FIGS. 9 to 20, each of the front and rear pillars 84, 86 is at least mainly (i.e., mainly or entirely) made of the material $M_1$, while the blade-retaining base 80 is at least mainly made of the material $M_2$. In this example, each of the front and rear pillars 84, 86 is entirely made of the material $M_1$, while a major part 63 of the blade-retaining base 80 is made of the material $M_2$ and a thin upper part 69 of the bridge 88 of the blade-retaining base 80 is made of the material $M_1$. More specifically, in this example, the thin upper part 69 of the bridge 88 of the blade-retaining base 80 is integrally formed and continuous with the front and rear pillars 84, 86 such that the thin upper part 69 of the bridge 88 and the front and rear pillars 84, 86 constitute a monolithic one-piece upper component 77 of the blade holder 28 that is made of the material $M_1$, while the major part 63 of the blade-retaining base 80 constitutes a monolithic one-piece lower component 78 of the blade holder 28 that is made of the material $M_2$. In other embodiments, different parts of the front and rear pillars 84, 86 and the blade-retaining base 80 may be made of the materials $M_1$, $M_2$.

The materials $M_1$, $M_2$ may differ in rigidity to any suitable degree. For example, in some embodiments, a ratio $\lambda_1/\lambda_2$ of a modulus of elasticity $\lambda_1$ (e.g., tensile modulus) of the material $M_1$ over a modulus of elasticity $\lambda_2$ of the material $M_2$ may be at least 2, in some cases at least 5, in some cases at least 10, in some cases at least 20, in some cases at least 50, and in some cases even more (e.g., at least 100). This ratio may have any other suitable value in other embodiments.

For instance, in some embodiments, the modulus of elasticity $\lambda_1$ of the material $M_1$ may be at least 25 GPa, in some cases at least 50 GPa, in some cases at least 100 GPa, and in some cases even more (e.g., at least 150 GPa or 200 GPa), and/or the modulus of elasticity $\lambda_2$ of the material $M_2$ may be no more than 20 GPa, in some cases no more than 10 GPa, in some cases no more than 5 GPa, and in some cases even less (e.g., no more than 2 GPa or 1 GPa). The modulus of elasticity $\lambda_1$ of the material $M_1$ and/or the modulus of elasticity $\lambda_2$ of the material $M_2$ may have any other suitable value in other embodiments.

In this embodiment, the material $M_1$ is denser than the material $M_2$ and, thus, in addition to making the blade-retaining base 80 less stiff for better feel and control, the material $M_2$ which is less dense than the material $M_1$ helps to reduce the weight of the blade holder 28.

The materials $M_1$, $M_2$ may differ in density to any suitable degree. For example, in some embodiments, a ratio $\rho_1/\rho_2$ of a density $\rho_1$ of the material $M_1$ over a density $\rho_2$ of the material $M_2$ may be at least 1.1, in some cases at least 1.2, in some cases at least 1.3, and in some cases even more (e.g., at least 1.5). This ratio may have any other suitable value in other embodiments.

For instance, in some embodiments, the density $\rho_1$ of the material $M_1$ may be at least 1 g/cm$^3$, in some cases at least 1.2 g/cm$^3$, in some cases at least 1.4 g/cm$^3$, in some cases at least 1.8 g/cm$^3$, in some cases at least 2 g/cm$^3$, and in some cases even more (e.g., at least 2.5 g/cm$^3$ or 3 g/cm$^3$), and/or the density $\rho_2$ of the material $M_2$ may be no more than 2 g/cm$^3$, in some cases no more than 1.8 g/cm$^3$, in some cases no more than 1.4 g/cm$^3$, in some cases no more than 1.2 g/cm$^3$ and in some cases even less (e.g., no more than 1 g/cm$^3$ or 0.8 g/cm$^3$). The density $\rho_1$ of the material $M_1$ and/or the density $\rho_2$ of the material $M_2$ may have any other suitable value in other embodiments.

In this embodiment, the material $M_1$ is a composite material and the material $M_2$ is a non-composite material (i.e., a material that is not a composite material). In this example, the non-composite material $M_2$ is a non-composite polymeric material.

More particularly, in this embodiment, the composite material $M_1$ is a fiber-matrix composite material that comprises a matrix 90 in which fibers $\mathbf{92}_1$-$\mathbf{92}_F$ are embedded.

The matrix 90 may include any suitable substance. In this embodiment, the matrix 90 is a polymeric matrix. Thus, in this example of implementation, the composite material $M_1$ is a fiber-reinforced plastic (FRP—a.k.a., fiber-reinforced polymer). The polymeric matrix 90 may include any suitable polymeric resin. For instance, in some examples, the polymeric matrix 90 may include a thermoplastic or thermosetting resin, such as epoxy, polyethylene, polypropylene, acrylic, thermoplastic polyurethane (TPU), polyether ether ketone (PEEK) or other polyaryletherketone (PAEK), polyethylene terephthalate (PET), polyvinyl chloride (PVC), poly(methyl methacrylate) (PMMA), polycarbonate, acrylonitrile butadiene styrene (ABS), nylon, polyimide, polysulfone, polyamide-imide, self-reinforcing polyphenylene, polyester, vinyl ester, vinyl ether, polyurethane, cyanate ester, phenolic resin, etc., a hybrid thermosetting-thermoplastic resin, or any other suitable resin. In this embodiment, the polymeric matrix 90 includes an epoxy resin.

The fibers $\mathbf{92}_1$-$\mathbf{92}_F$ may be made of any suitable material. In this embodiment, the fibers $\mathbf{92}_1$-$\mathbf{92}_F$ are carbon fibers. The composite material $M_1$ is thus a carbon-fiber-reinforced plastic in this example of implementation. Any other suitable type of fibers may be used in other embodiments (e.g., polymeric fibers such as aramid fibers (e.g., Kevlar fibers), boron fibers, silicon carbide fibers, metallic fibers, glass fibers, ceramic fibers, etc.).

In this embodiment, the fibers $\mathbf{92}_1$-$\mathbf{92}_F$ are continuous such that they constitute a continuous fiber reinforcement of the composite material $M_1$. For example, in this embodiment, the fibers $\mathbf{92}_1$-$\mathbf{92}_F$ may be provided as layers of continuous fibers (e.g. pre-preg (i.e., pre-impregnated) layers of fibers held together by an amount of matrix material, which is destined to provide a respective portion of the matrix 90 of the composite material $M_1$).

In this example, respective ones of the fibers $\mathbf{92}_1$-$\mathbf{92}_F$ are oriented differently. For example, in some embodiments, the fibers $\mathbf{92}_1$-$\mathbf{92}_F$ are arranged in layers stacked upon one another and may extend parallel or at an oblique angle to the longitudinal axis of the blade holder 28. For instance, given ones of the fibers $\mathbf{92}_1$-$\mathbf{92}_F$ in the layers that are stacked may be oriented at 0°, +/−45° and +/−90° in an alternating manner. The fibers $\mathbf{92}_1$-$\mathbf{92}_F$ may be arranged in any other suitable way in other examples.

In this embodiment, the polymeric material $M_2$ is a thermoplastic material. More particularly, in this example, the polymeric material $M_2$ is nylon (polyamide). The polymeric material $M_2$ may be any other suitable thermoplastic material in other examples (e.g., thermoplastic polyurethane (TPU), acrylonitrile butadiene styrene (ABS), etc.). The polymeric material $M_2$ may be a thermosetting material or any other suitable polymer in other embodiments (e.g., polypropylene, polyethylene (e.g., HDPE), polycarbonate, etc.).

With continued reference to FIGS. 3 to 20, in this embodiment, since it includes the composite material $M_1$ providing greater stiffness, parts of the blade holder 28 that are made of the composite material $M_1$ can be reduced in size in order to reduce the weight of the blade holder 28.

For instance, in this embodiment, the blade holder 28 comprises a void 94 between the front and rear pillars 84, 86 that is relatively large and thus helps to reduce its weight. Notably, in this example, the front and rear pillars 84, 86 are significantly spaced apart and relatively short in the longitudinal direction of the blade holder 28. A longitudinal extent V of the void 94 (i.e., a maximal distance between the front and rear pillars 84, 86 in the longitudinal direction of the blade holder 28) is relatively large and a minimal longitudinal dimension C of each of the front and rear pillars 84, 86 (i.e., a minimal dimension in the longitudinal direction of the blade holder 28 of each of the front and rear pillars 84, 86) is relatively small.

For example, in some embodiments, the longitudinal extent V of the void 94 between the front and rear pillars 84, 86 may be greater than a sum of the minimal longitudinal dimension C of the front pillars 84 and the minimal longitudinal dimension C of the rear pillar 86.

As another example, in some embodiments, the longitudinal extent V of the void 94 between the front and rear pillars 84, 86 may be greater than the minimal longitudinal dimension C of each of the front and rear pillars 84, 86. For instance, in some embodiments, a ratio WC of the longitudinal extent V of the void 94 between the front and rear pillars 84, 86 over the minimal longitudinal dimension C of each of the front and rear pillars 84, 86 may be at least 1.8, in some cases at least 2, in some cases at least 2.2, and in some cases even greater. This ratio may have any other value in other embodiments.

As yet another example, in some embodiments, a ratio V/L of the longitudinal extent V of the void 94 between the front and rear pillars 84, 86 over the length L of the blade holder 28 may be at least 0.4, in some cases at least 0.5, in some cases at least 0.6, and in some cases even greater. This ratio may have any other value in other embodiments.

For instance, in this embodiment, the length L of the blade holder 28 may be about 30 cm, the minimal longitudinal dimension C of the front pillar 84 may be about 7 cm, the minimal longitudinal dimension C of the rear pillar 86 may be about 7 cm, and the longitudinal extent V of the void 94 between the front and rear pillars 84, 86 may be about 15 cm for a size 8. The length L of the blade holder 28, the minimal longitudinal dimension C of each of the front and rear pillars 84, 86, and the longitudinal extent V of the void 94 between the front and rear pillars 84, 86 may have any other suitable values in other embodiments.

In this embodiment, each of the front and rear pillars 84, 86 comprises a wall 95 that defines a cavity 96. In this example, the wall 95 is made of the composite material $M_1$ and can be relatively thin. For instance, in some embodiments, a thickness T of the wall 95 may be no more than 5 mm, in some cases no more than 4 mm, in some cases no more than 3 mm, in some cases no more than 2 mm, and in some cases even less. The thickness T of the wall 95 may have any other suitable value in other embodiments.

In this example of implementation, each of the front and rear pillars 84, 86 comprises a top opening 97 that leads to its cavity 96 and faces the skate boot 11 when the blade holder 28 is mounted to the skate boot 11.

Also, in this example of implementation, each of the front and rear pillars 84, 86 comprises a peripheral opening 98 that leads to its cavity 96 such that its cavity 96 is exposed from an exterior of the skate 10 when the blade holder 28 is mounted to the skate boot 11. That is, each of the front and rear pillars 84, 86 is open peripherally such that its cavity 96 opens up to the exterior of the skate 10 when the blade holder 28 is mounted to the skate boot 11. More particularly, in this example of implementation, the peripheral opening 98 of the front pillar 84 and the peripheral opening 98 of the rear pillar 86 face one another.

Therefore, in this embodiment, even though it includes significant parts made of the composite material $M_1$, in view of a reduction in size of these parts and/or use of the polymeric material $M_2$ which is less dense, the weight of the blade holder 28 can be relatively low. For example, in some embodiments, a ratio of the weight of the blade holder 28 over the length L of the blade holder 28 may be no more than 4.3 g/cm, in some cases no more than 4 g/cm, in some cases no more than 3.7 g/cm, in some cases no more than 3.5 g/cm, and in some cases even less (e.g., no more than 3.3 g/cm). For instance, in some embodiments, if the length L of the blade holder 28 is about 30 cm (e.g., for a size 8), the weight of the blade holder 28 may be no more than 130 g, in some cases no more than 120 g, in some cases no more than 110 g, in some cases no more than 105 g, and in some cases even less (e.g., no more than 100 g). The weight of the blade holder 28 may have any other suitable value in other embodiments.

The composite material $M_1$ and the polymeric material $M_2$ making up respective portions of the blade holder 28 may be interconnected in any suitable way.

In this embodiment, the composite material $M_1$ and the polymeric material $M_2$ are mechanically interlocked. That is, the composite material $M_1$ and the polymeric material $M_2$ are in a mechanical interlock relationship in which they are interconnected via a part of the blade holder 28 made of a given one of the composite material $M_1$ and the polymeric material $M_2$ extending into a part of the blade holder 28 made of the other one of the composite material $M_1$ and the polymeric material $M_2$. More specifically, the part of the blade holder 28 made of the given one of the composite material $M_1$ and the polymeric material $M_2$ comprises an interlocking space (e.g., one or more holes, one or more recesses, and/or one or more other hollow areas) into which extends an interlocking portion of the part of the blade holder 28 made of the other one of the composite material $M_1$ and the polymeric material $M_2$.

Figure 26:
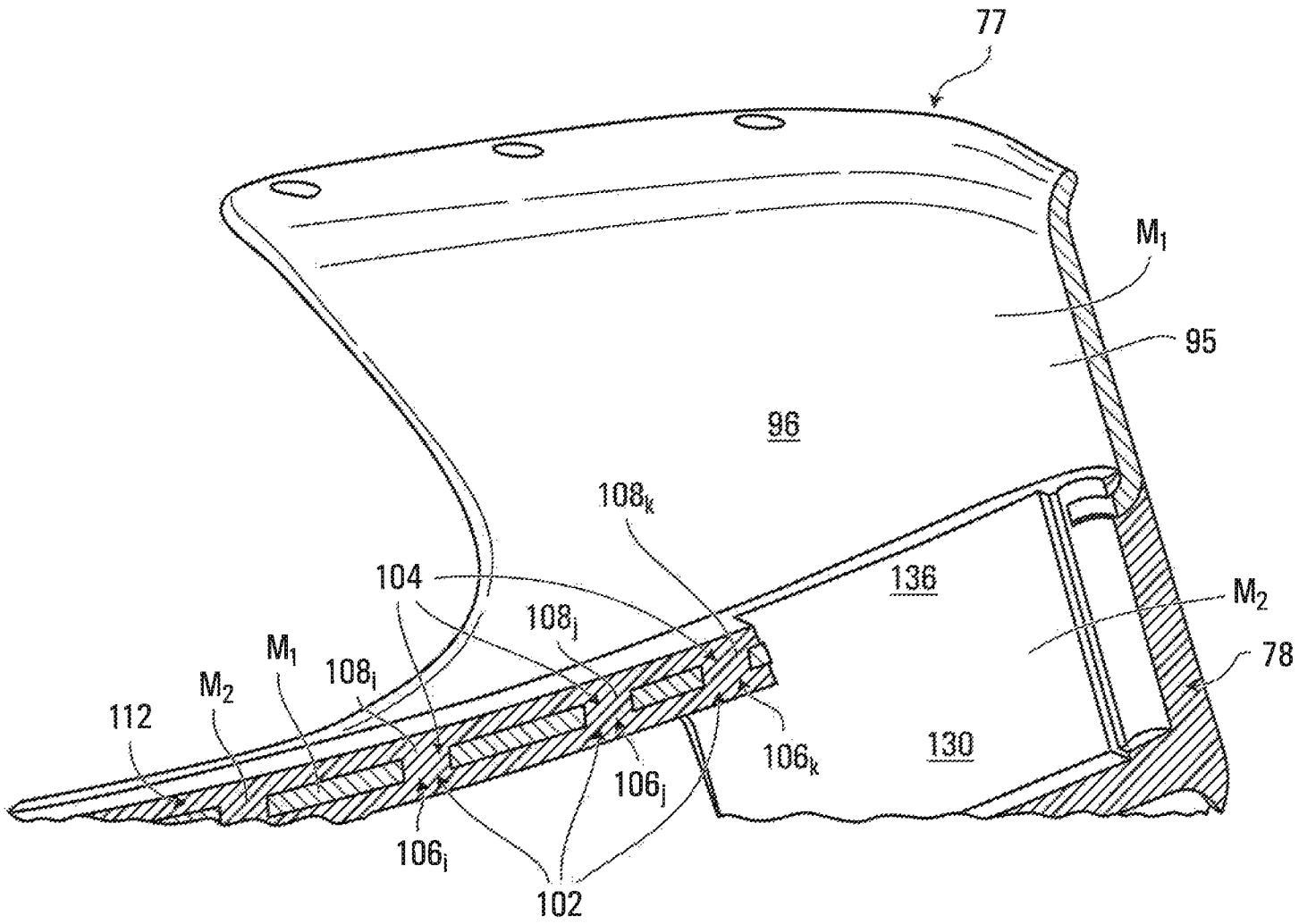

More particularly, in this embodiment, with additional reference to FIG. 26, the upper component 77 of the blade holder 28 made of the composite material $M_1$ and including the front and rear pillars 84, 86 and the thin upper part 69 of the bridge 88 comprises an interlocking space 102 into which extends an interlocking portion 104 of the lower component 78 of the blade holder 28 made of the polymeric material $M_2$ and including the major part 63 of the blade-retaining base 80. In this example, the interlocking space 102 of the upper component 77 of the blade holder 28 made of the composite material $M_1$ comprises a plurality of holes $\mathbf{106}_1$-$\mathbf{106}_H$ (e.g., which may have been pre-molded or drilled) and the interlocking portion 104 of the lower component 78 of the blade holder 28 made of the polymeric material $M_2$ comprises a plurality of elements $\mathbf{108}_1$-$\mathbf{108}_H$ that extend into respective ones of the holes $\mathbf{106}_1$-$\mathbf{106}_H$ to interlock the composite material $M_1$ and the polymeric material $M_2$ together.

In this example of implementation, the blade holder 28 is manufactured using an overmolding process in which the polymeric material $M_2$ is overmolded onto the composite material $M_1$ to create an overmolded joint 112 between the polymeric material $M_2$ and composite material $M_1$. More particularly, during the overmolding process, the polymeric material $M_2$ flows into the holes $\mathbf{106}_1$-$\mathbf{106}_H$ of the upper component 77 of the blade holder 28 made of the composite material $M_1$ where it is captured to mechanically interlock the polymeric material $M_2$ and composite material at the joint 112. In some cases, the thermoplastic material $M_2$ and the matrix 90 of the composite material $M_1$ may enhance retention of the materials $M_1$, $M_2$ together (e.g., by creating a chemical bond between them).

More particularly, in this example of implementation, the upper component 77 of the blade holder 28 made of the composite material $M_1$ may be manufactured by providing a plurality of layers of fibers, which are destined to provide the fibers $\mathbf{92}_1$-$\mathbf{92}_F$ of the composite material $M_1$, onto one another on a supporting structure which is then placed in a mold to consolidate the composite material $M_1$. In this embodiment, each of these layers of fibers is provided as a pre-preg (i.e., pre-impregnated) layer of fibers held together by an amount of matrix material, which is destined to provide a respective portion of the matrix 90 of the composite material $M_1$. The supporting structure onto which the pre-preg layers of fibers are layered may be implemented in any suitable manner (e.g., one or more silicone mold parts, one or more inflatable bladders, etc.). In other embodiments, the matrix 90 of the composite material $M_1$ may be provided separately from (e.g., injected onto) the layers of fibers. The holes $\mathbf{106}_1$-$\mathbf{106}_H$ for eventual interlocking of the polymeric material $M_2$ may be molded in the mold in which the composite material $M_1$ is consolidated or may be drilled after consolidation of the composite material $M_1$ in the mold. Various other manufacturing techniques may be used to make the upper component 77 of the blade holder 28 made of the composite material $M_1$.

Once the upper component 77 of the blade holder 28 made of the composite material $M_1$ is formed, in this example of implementation, the lower component 78 of the blade holder 28 made of the polymeric material $M_2$ may be manufactured by overmolding the polymeric material $M_2$ onto the composite material $M_1$. For instance, the polymeric material $M_2$ may be injected into a mold in which the upper component 77 of the blade holder 28 is disposed.

The blade holder 28 can be manufactured using any other suitable process in other embodiments.

In this embodiment, the blade-detachment mechanism 55 of the blade holder 28 to selectively attach and detach the blade 52 to and from the blade holder 28 is disposed in a cavity 130 defined by a wall 132 of the blade-retaining base 80 made of the polymeric material $M_2$. The polymeric material $M_2$ is thus disposed between the blade 52 and the composite material $M_1$. The greater compliance of the polymeric material $M_2$, and possibly its greater ductility, may help to isolate the composite material $M_1$ from the blade 52 and the blade-detachment mechanism 55 and thus reduce a potential for rattling or other vibrations to be transmitted to the composite material $M_1$ (e.g., thereby reducing a potential for local stresses and crack formation in the composite material $M_1$). The polymeric material $M_2$ may thus serve as a "bumper" between the blade 52 and the composite material $M_1$. In this example, the cavity 130 is contiguous to the cavity 96 defined by the wall 95 of the rear pillar 86 such that an opening 136 links the cavity 130 and the cavity 96 which constitute a common continuous hollow space. In other examples, the cavity 130 may be isolated from the cavity 96 defined by the wall 95 of the rear pillar 86.

The blade 52 comprises an ice-contacting material 140 including an ice-contacting surface 127 for sliding on the ice surface while the skater skates. In this embodiment, the ice-contacting material 140 is a metallic material (e.g., stainless steel). The ice-contacting material 140 may be any other suitable material in other embodiments. Also, in this embodiment, an entirety of the blade 52 is made of the ice-contacting material 140.

The ice skate 10, including the blade holder 28, may be implemented in any other suitable way in other embodiments.

Figure 36:
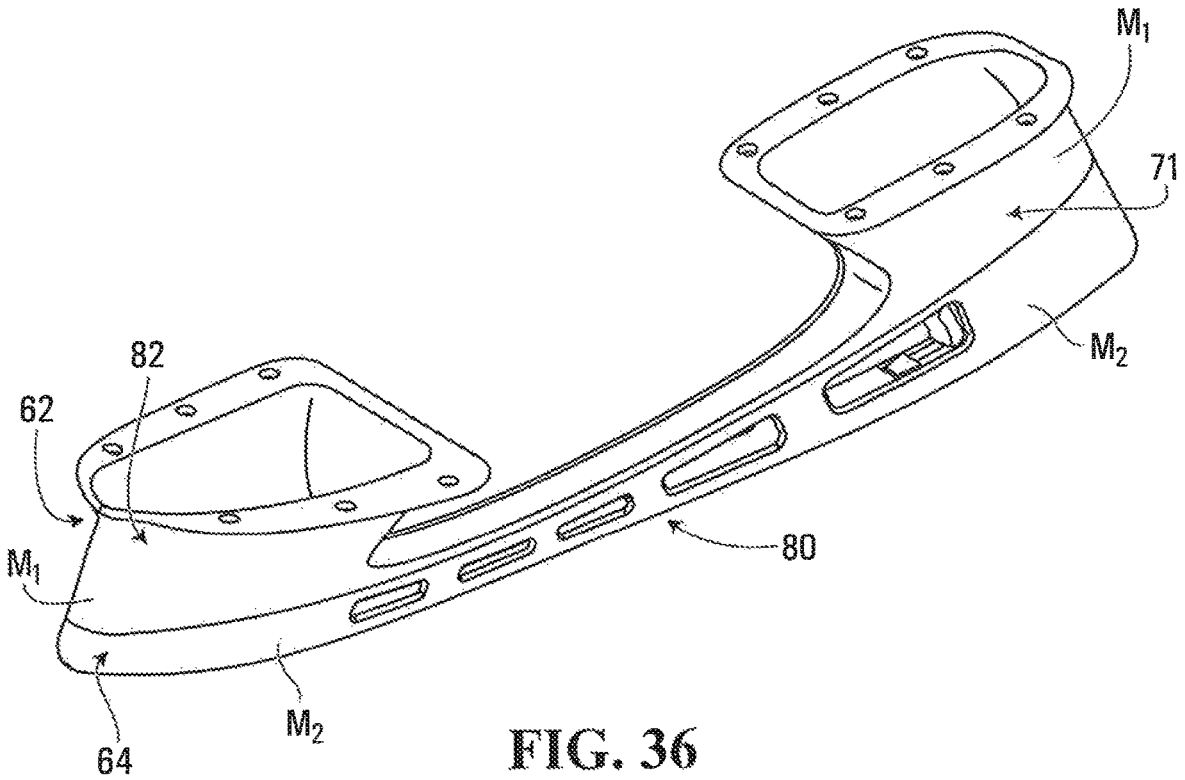
FIGS. 36 to 38 show examples of other shapes of the blade holder in other embodiments.
Figure 37:
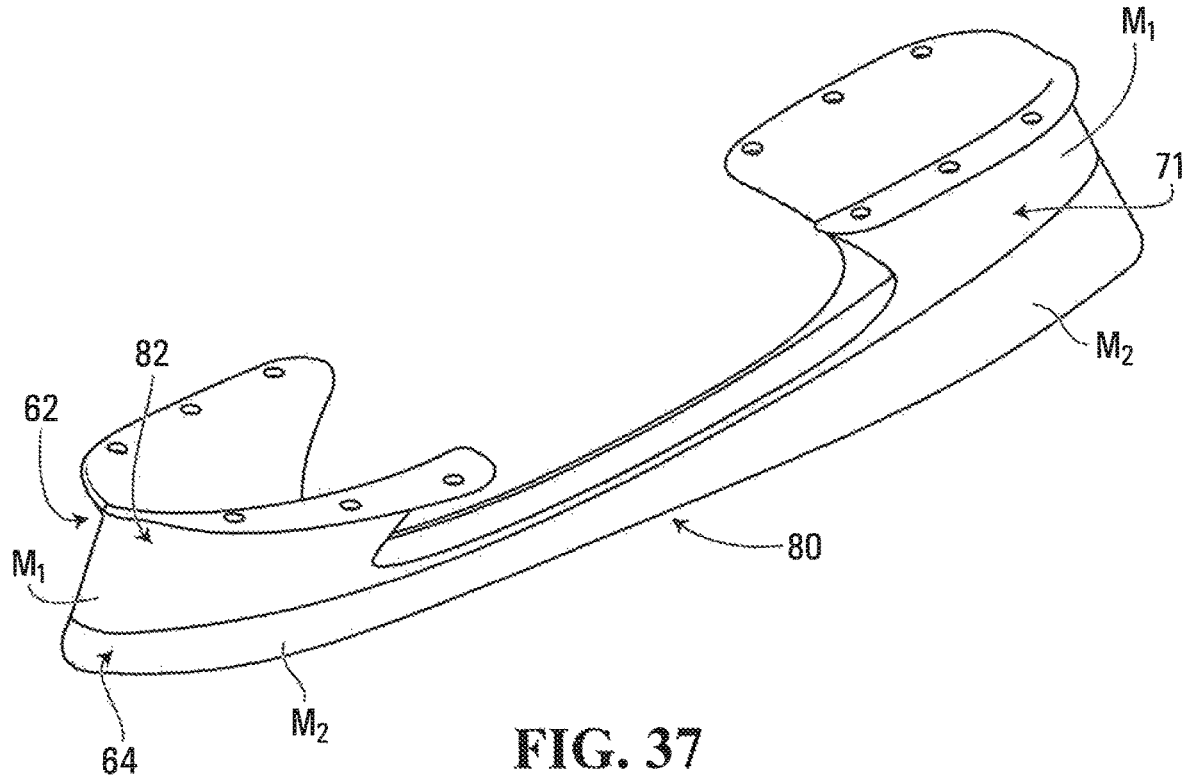
Figure 38:
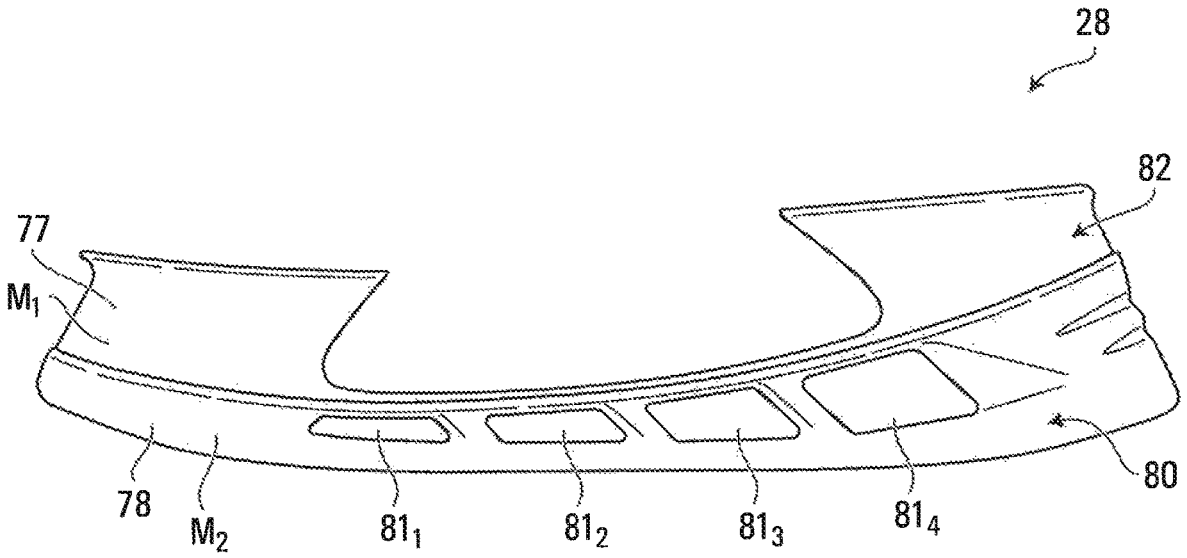

For example, in other embodiments, the blade holder 28 may have any other suitable shape. For instance, in other embodiments, the support 82 and/or the blade-retaining base 80 may be shaped in various other ways (e.g., the front and rear pillars 84, 86 may be shaped differently; the blade-retaining base 80 may have more, fewer, or no apertures such as the apertures $\mathbf{81}_1$-$\mathbf{81}_5$; etc). As an example, FIG. 36 shows an embodiment in which the front and rear pillars 84, 86 are open only at their top opening 97 (i.e., they lack any peripheral opening such as the peripheral opening 98). As another example, FIG. 38 shows an embodiment in which in which the blade-retaining base 80 has four apertures such as the apertures $\mathbf{81}_1$-$\mathbf{81}_5$. As yet another example, FIG. 37 shows an embodiment in which the blade-retaining base 80 has no apertures such as the apertures $\mathbf{81}_1$-$\mathbf{81}_5$.

In other embodiments, the composite material $M_1$ and the polymeric material $M_2$ of the blade holder 28 may be interconnected in any other suitable way.

Figure 39:
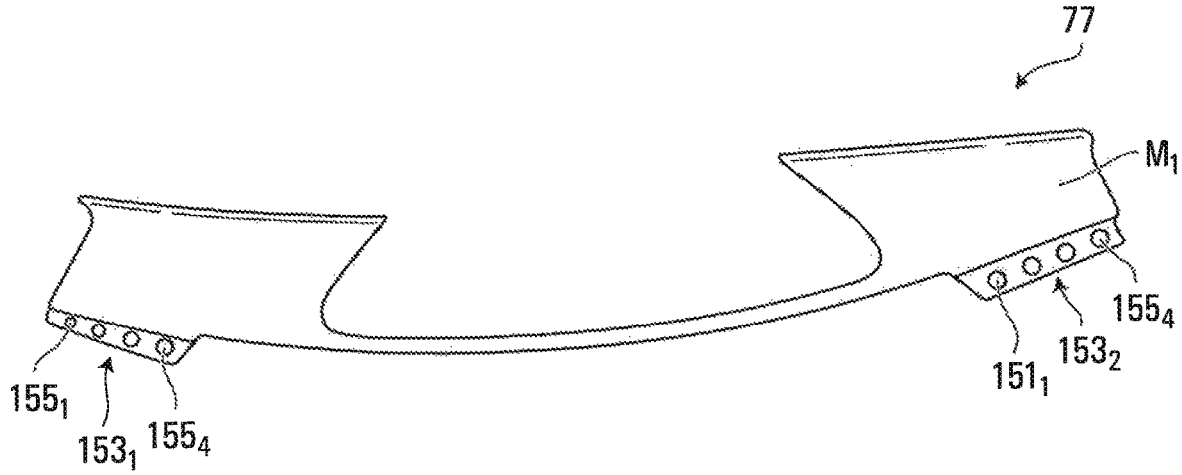
FIG. 39 shows an example of a variant of the upper component of the blade holder.

For example, in some embodiments, as shown in FIGS. 38 and 39, the upper component 77 of the blade holder 28 made of the composite material $M_1$ comprises a plurality of projections $\mathbf{153}_1$,$\mathbf{153}_2$ that project towards the lower component 78 of the blade holder 28 made of the polymeric material $M_2$ and that include part of the interlocking space 102 into which extends the interlocking portion 104 of the lower component 78 of the blade holder 28. In this embodiment, each of the projections $\mathbf{153}_1$,$\mathbf{153}_2$ is a flap, the part of the interlocking space 102 of the upper component 77 of the blade holder 28 formed by each of the flaps $\mathbf{153}_1$,$\mathbf{153}_2$ comprises a plurality of holes $\mathbf{155}_1$,$\mathbf{155}_4$ (e.g., which may have been pre-molded or drilled), and the interlocking portion 104 of the lower component 78 of the blade holder 28 comprises a plurality of elements $\mathbf{168}_1$-$\mathbf{168}_8$ that extend into respective ones of the holes $\mathbf{155}_1$-$\mathbf{155}_4$ of each of the flaps $\mathbf{153}_1$,$\mathbf{153}_2$ to interlock the composite material $M_1$ and the polymeric material $M_2$ together. Thus, in this embodiment, the holes $\mathbf{106}_1$-$\mathbf{106}_H$ and the holes $\mathbf{155}_1$-$\mathbf{155}_4$ of the interlocking space 102 of the upper component 77 of the blade holder 28 are oriented differently such that the elements $\mathbf{108}_1$-$\mathbf{108}_H$ and the elements $\mathbf{168}_1$-$\mathbf{168}_8$ of the interlocking portion 104 of the lower component 78 of the blade holder 28 extend transversally to one another (e.g., in this case, the elements $\mathbf{108}_1$-$\mathbf{108}_H$ extend into the holes $\mathbf{106}_1$-$\mathbf{106}_H$ generally vertically and the elements $\mathbf{168}_1$-$\mathbf{168}_8$ extend into the holes $\mathbf{155}_1$-$\mathbf{155}_4$ generally horizontally). In some cases, this may help to further enhance mechanical interlocking of the composite material $M_1$ and the polymeric material $M_2$.

Figure 27:
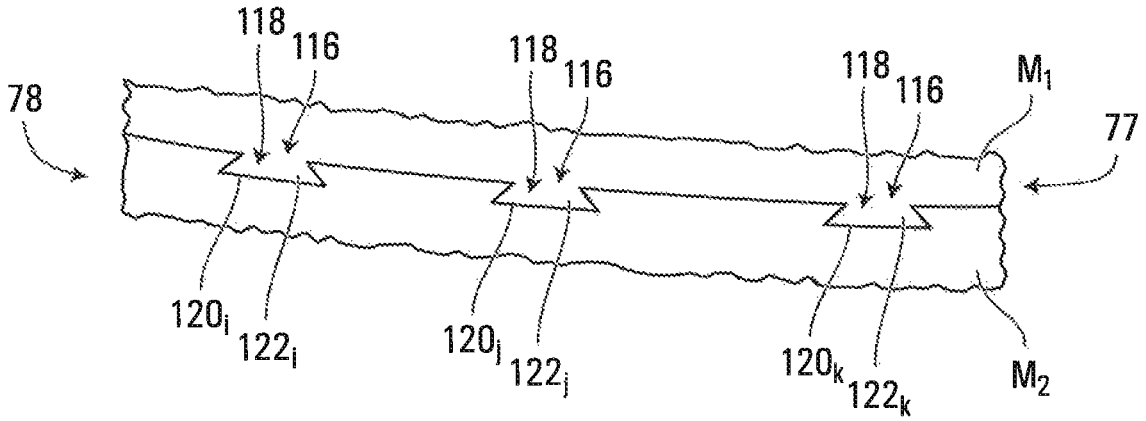
FIGS. 27 to 29 show examples of variants of an interconnection of different parts of the blade holder.

As another example, in some embodiments, as shown in FIG. 27, instead of or in addition to the upper component 77 of the blade holder 28 made of the composite material $M_1$ comprising the interlocking space 102 into which extends the interlocking portion 104 of the lower component 78 of the blade holder 28 made of the polymeric material $M_2$, the lower component 78 of the blade holder 28 made of the polymeric material $M_2$ may comprise an interlocking space 116 into which extends an interlocking portion 118 of the upper component 77 of the blade holder 28 made of the composite material $M_1$. For instance, in this embodiment, the interlocking space 116 of the lower component 78 of the blade holder 28 made of the polymeric material $M_2$ comprises a plurality of holes $\mathbf{120_1}$-$\mathbf{120_J}$ (e.g., which may have been pre-molded or drilled) and the interlocking portion 118 of the upper component 77 of the blade holder 28 made of the composite material $M_1$ comprises a plurality of elements $\mathbf{122_1}$-$\mathbf{122_J}$ that extend into respective ones of the holes $\mathbf{120_1}$-$\mathbf{120_J}$ to interlock the composite material $M_1$ and the polymeric material $M_2$ together. In this example, the thermoplastic resin of the matrix 90 of the composite material $M_1$ when provided (e.g., injected) flows into the holes $\mathbf{120_1}$-$\mathbf{120_J}$ defined by the polymeric material $M_2$ to create the elements $\mathbf{122_1}$-$\mathbf{122J}$ that interlock the composite material $M_1$ and the polymeric material $M_2$ together.

Figure 28:
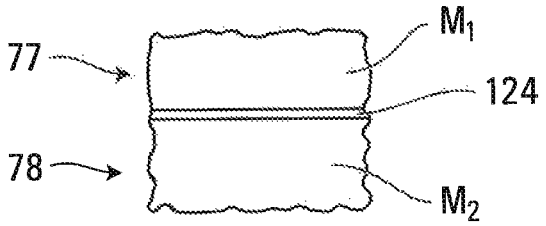

As another example, in some embodiments, as shown in FIG. 28, instead of or in addition to the composite material $M_1$ and the polymeric material $M_2$ being mechanically interlocked, the composite material $M_1$ and the polymeric material $M_2$ may be adhesively bonded by an adhesive 124. The adhesive 124 may be an epoxy-based adhesive, a polyurethane-based adhesive, a methacrylate adhesive, a methyl methacrylate adhesive, or any other suitable adhesive for bonding the composite material $M_1$ and the polymeric material $M_2$.

Figure 29:
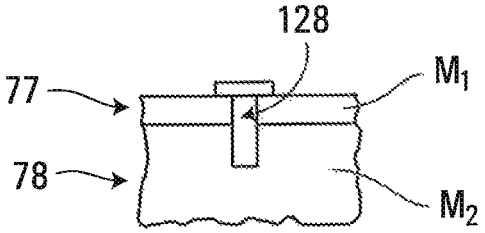

As another example, in some embodiments, as shown in FIG. 29, instead of or in addition to the composite material $M_1$ and the polymeric material $M_2$ being mechanically interlocked and/or adhesively bonded, the composite material $M_1$ and the polymeric material $M_2$ may be fastened using one or more fasteners 128. Each fastener 128 may be a rivet, a screw, a bolt, or any other suitable mechanical fastener While in embodiments considered above the different materials $M_1$, $M_2$ making up respective parts of the blade holder 28 include a composite material and a non-composite polymeric material, the different materials $M_1$, $M_2$ may include any other suitable combination of materials in other embodiments. For example, in some embodiments, the material $M_1$ may be a composite material and the material $M_2$ may be a different composite material (e.g., less stiff than the composite material $M_1$, by including fewer and/or less rigid fibers in its matrix and/or having its matrix more compliant than the composite material $M_1$). For instance, in some embodiments, the composite material $M_1$ may include continuous fibers (e.g., pre-prep layers of fibers) providing a continuous fiber reinforcement as discussed above, while the composite material $M_2$ may include discontinuous (e.g., chopped) fibers randomly dispersed within its matrix. For example, in some cases, the composite material $M_2$ may include a nylon matrix in which are dispersed chopped fibers (e.g., 10% or 20% chopped fibers) such as carbon or aramid fibers, which may also enhance abrasion resistance).

Also, while in embodiments considered above there are two different materials $M_1$, $M_2$ making up respective parts of the blade holder 28, the material distribution profile of the blade holder 28 may include three or more different materials making up respective parts of the blade holder 28 such as described above in relation to the materials $M_1$, $M_2$.

Figure 30:
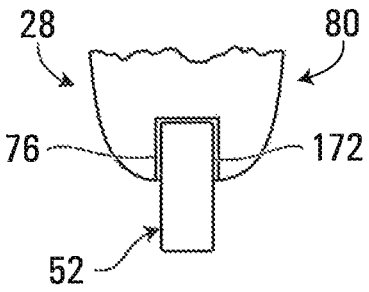
FIGS. 30 to 33 show examples of variants in which the blade holder may retain the blade.
Figure 31:
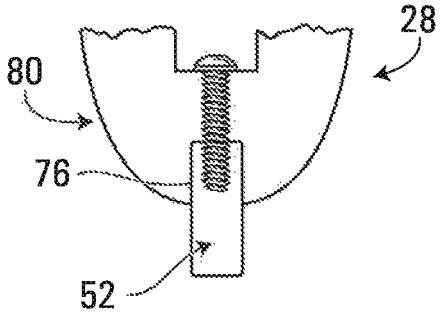
Figure 32:
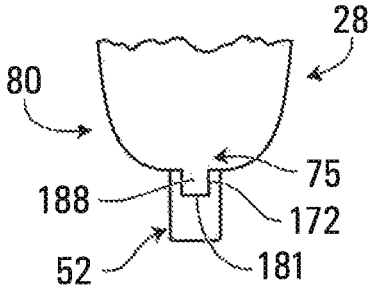
Figure 33:
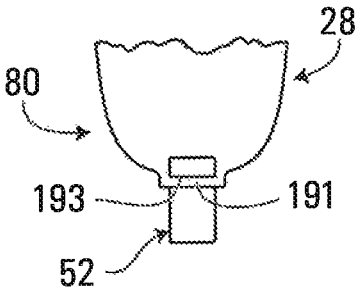

In other embodiments, the blade holder 28 may retain the blade 52 in any other suitable way. For instance, instead of being selectively detachable and removable from and attachable to the blade holder 28, in other embodiments, the blade 52 may be permanently affixed to the blade holder 28 (i.e., not intended to be detached and removed from the blade holder 28). As an example, in some embodiments, as shown in FIGS. 30 and 31, the blade holder 28 may retain the blade 52 using an adhesive 172 and/or one or more fasteners 175. For instance, in some embodiments, as shown in FIG. 30, the recess 76 of the blade holder 28 may receive the upper part of the blade 52 that is retained by the adhesive 172. The adhesive 172 may be an epoxy-based adhesive, a polyurethane-based adhesive, or any suitable adhesive. In some embodiments, instead of or in addition to using an adhesive, as shown in FIG. 31, the recess 76 of the blade holder 28 may receive the upper part of the blade 52 that is retained by the one or more fasteners 175. Each fastener 175 may be a rivet, a screw, a bolt, or any other suitable mechanical fastener. Alternatively or additionally, in some embodiments, as shown in FIG. 32, the blade-retention portion 75 of the blade holder 28 may extend into a recess 181 of the upper part of the blade 52 to retain the blade 52 using the adhesive 172 and/or the one or more fasteners 175. For instance, in some cases, the blade-retention portion 75 of the blade holder 28 may comprise a projection 188 extending into the recess 181 of the blade 52. As another example, in some embodiments, as shown in FIG. 33, the blade 52 and the blade-retaining base 80 of the blade holder 28 may be mechanically interlocked via an interlocking portion 191 of one of the blade-retaining base 80 and the blade 52 that extends into an interlocking void 193 of the other one of the blade-retaining base 80 and the blade 52. For instance, in some cases, the blade 52 can be positioned in a mold used for molding the blade holder 28 such that, during molding, the interlocking portion 191 of the blade-retaining base 80 flows into the interlocking void 193 of the blade 52 (i.e., the blade holder 28 is overmolded onto the blade 52).

The blade 52 may be implemented in any other suitable way in other embodiments.

Figure 34:
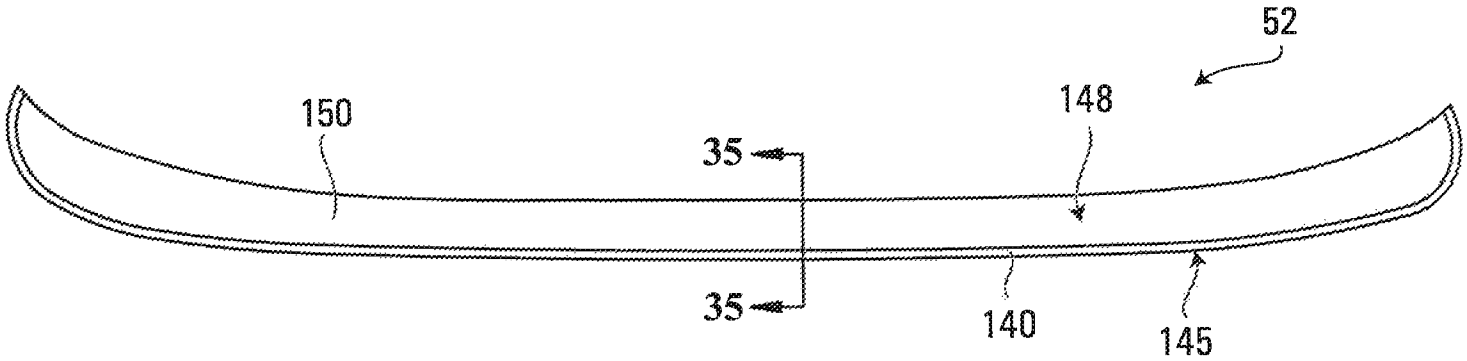
FIGS. 34 and 35 show an example of a variant of the blade.
Figure 35:
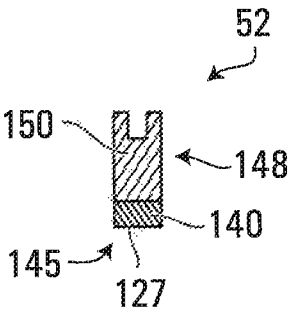

For example, in some embodiments, as shown in FIGS. 34 and 35, the blade 52 may comprise a runner 145 that is made of the ice-contacting material 140 and includes the ice-contacting surface 127 and a body 148 connected to the runner 145 and made of a material 150 different from the ice-contacting material 140. The runner 145 and the body 148 of the blade 52 may be retained together in any suitable way. For example, in some cases, the runner 145 may be adhesively bonded to the body 148 using an adhesive. As another example, in addition to or instead of being adhesively bonded, the runner 145 and the body 148 may be fastened using one or more fasteners (e.g., rivets, screws, bolts, etc.). As yet another example, the runner 145 and the body 148 may be mechanically interlocked by an interlocking portion of one of the runner 145 and the body 148 that extends into an interlocking space (e.g., one or more holes, one or more recesses, and/or one or more other hollow areas) of the other one of the runner 145 and the body 148 (e.g., the body 148 may be overmolded onto the runner 145).

To facilitate the description, any reference numeral designating an element in one figure designates the same element if used in any other figures. In describing the embodiments, specific terminology has been resorted to for the sake of clarity but the invention is not intended to be limited to the specific terms so selected, and it is understood that each specific term comprises all equivalents.

In some embodiments, any feature of any embodiment described herein may be used in combination with any feature of any other embodiment described herein.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

Although various embodiments have been illustrated, this was for the purpose of describing, but not limiting, the invention. Various modifications will become apparent to those skilled in the art and are within the scope of this invention, which is defined more particularly by the attached claims.

The invention claimed is:

1. A blade holder for an ice skate, the ice skate comprising a skate boot for receiving a foot of a skater, the blade holder comprising:

a. a blade-retaining base to retain a blade, the blade-retaining base comprising a first material;

b. a support extending upwardly from the blade-retaining base to interconnect the blade holder and the skate boot, the support comprising a second material stiffer than the first material; and c. a blade-detachment mechanism comprising an actuator toollessly operable such that the blade is selectively detachable and removable from, and attachable to, the blade holder, at least part of the blade-detachment mechanism being disposed in a cavity defined by a wall at least partly made of the first material.

2. The blade holder of claim 1, wherein the second material is a composite material.

3. The blade holder of claim 2, wherein the first material is a non-composite material.

4. The blade holder of claim 1, wherein a ratio of a modulus of elasticity of the second material over a modulus of elasticity of the first material is at least 2.

5. The blade holder of claim 1, wherein a ratio of a modulus of elasticity of the second material over a modulus of elasticity of the first material is at least 10.

6. The blade holder of claim 1, wherein a ratio of a density of the second material over a density of the first material is at least 1.2.

7. The blade holder of claim 1, wherein the support comprises a front pillar and a rear pillar and the blade-retaining base comprises a bridge interconnecting the front pillar and the rear pillar.

8. The blade holder of claim 7, wherein at least a majority of the front pillar and the rear pillar is made of the second material.

9. The blade holder of claim 8, wherein at least a majority of the bridge is made of the first material.

10. The blade holder of claim 7, wherein: the front pillar, the rear pillar and an upper part of the bridge are made of the second material and constitute a monolithic one-piece upper component of the blade holder; and a major part of the blade-retaining base is made of the first material and constitutes a monolithic one-piece lower component of the blade holder.

11. The blade holder of claim 7, comprising a void extending from the front pillar to the rear pillar, wherein a longitudinal extent of the void in a longitudinal direction of the blade holder is greater than a sum of a minimal longitudinal dimension of the front pillar in the longitudinal direction of the blade holder and a minimal longitudinal dimension of the rear pillar in the longitudinal direction of the blade holder.

12. The blade holder of claim 7, comprising a void extending from the front pillar to the rear pillar, wherein a longitudinal extent of the void in a longitudinal direction of the blade holder is greater than a minimal longitudinal dimension of the front pillar in the longitudinal direction of the blade holder and a minimal longitudinal dimension of the rear pillar in the longitudinal direction of the blade holder.

13. The blade holder of claim 1, wherein a thickness T of the wall is no more than 5 mm.

14. The blade holder of claim 3, wherein the first material and the second material are mechanically interlocked.

15. The blade holder of claim 14, wherein a given one of the first material and the second material is overmolded onto the other one of the first material and the second material to mechanically interlock the first material and the second material.

16. The blade holder of claim 1, wherein a ratio of a weight of the blade holder over a length of the blade holder is no more than 4.3 g/cm.

17. A blade holder for an ice skate, the ice skate comprising a skate boot for receiving a foot of a skater, the blade holder comprising:

a. a blade-retaining base to retain a blade, the blade-retaining base comprising a first polymeric material; and b. a support extending upwardly from the blade-retaining base to interconnect the blade holder and the skate boot such that the blade holder is below the skate boot, the support comprising a second polymeric material different from the first polymeric material;

wherein: the first polymeric material and the second polymeric material are disposed to be located below the skate boot and interconnected by molding of at least one of the first polymeric material and the second polymeric material such that a given one of the first polymeric material and the second polymeric material defines a hollow interlocking space occupied by the other one of the first polymeric material and the second polymeric material; the support comprises a front pillar and a rear pillar and the blade-retaining base comprises a bridge interconnecting the front pillar and the rear pillar; and at least a given one of the front pillar and the rear pillar comprises: a wall defining a cavity and at least partly made of the second material; a top opening that leads to its cavity and faces the skate boot when the blade holder is mounted to the skate boot; and a peripheral opening that leads to its cavity such that its cavity is exposed from an exterior of the skate when the blade holder is mounted to the skate boot.

18. The blade holder of claim 17, wherein at least a majority of the front pillar and the rear pillar is made of the second material.

19. The blade holder of claim 18, wherein at least a majority of the bridge is made of the first material.

20. The blade holder of claim 17, wherein: the front pillar, the rear pillar and an upper part of the bridge are made of the second material and constitute a monolithic one-piece upper component of the blade holder; and a major part of the blade-retaining base is made of the first material and constitutes a monolithic one-piece lower component of the blade holder.

21. The blade holder of claim 17, comprising a void extending from the front pillar to the rear pillar, wherein a longitudinal extent of the void in a longitudinal direction of the blade holder is greater than a minimal longitudinal dimension of the front pillar in the longitudinal direction of the blade holder and a minimal longitudinal dimension of the rear pillar in the longitudinal direction of the blade holder.

22. The blade holder of claim 17, wherein a thickness T of the wall is no more than 5 mm.

23. The blade holder of claim 17, wherein the second material is a composite material.

24. The blade holder of claim 23, wherein the first material is a non-composite material.

25. The blade holder of claim 17, wherein the second material is stiffer than the first material.

26. A blade holder for an ice skate, the ice skate comprising a skate boot for receiving a foot of a skater, the blade holder comprising:

a. a blade-retaining base to retain a blade, the blade-retaining base comprising a first polymeric material; and b. a support extending upwardly from the blade-retaining base to interconnect the blade holder and the skate boot such that the blade holder is below the skate boot, the support comprising a second polymeric material different from the first polymeric material;

wherein: the first polymeric material and the second polymeric material are disposed to be located below the skate boot; and the blade holder comprises an overmolding joint between the first polymeric material and the second polymeric material.

27. The blade holder of claim 26, wherein the second material is a composite material.

28. The blade holder of claim 27, wherein the first material is a non-composite material.

29. The blade holder of claim 26, wherein the second material is stiffer than the first material.

30. The blade holder of claim 26, wherein a ratio of a weight of the blade holder over a length of the blade holder is no more than 4.3 g/cm.

31. The blade holder of claim 26, wherein the first polymeric material and the second polymeric material are interconnected by molding a given one of the first polymeric material and the second polymeric material over the other one of the first polymeric material and the second polymeric material.

32. The blade holder of claim 31, wherein the other one of the first polymeric material and the second polymeric material defines a hollow interlocking space permanently occupied by the given one of the first polymeric material and the second polymeric material to affix the first polymeric material and the second polymeric material together by mechanical interlock.

* * * * *